US006532409B1

(12) United States Patent
Fujishima et al.

(10) Patent No.: US 6,532,409 B1
(45) Date of Patent: Mar. 11, 2003

(54) TARGET EXCAVATION SURFACE SETTING DEVICE FOR EXCAVATION MACHINE, RECORDING MEDIUM THEREFOR AND DISPLAY UNIT

(75) Inventors: Kazuo Fujishima, Ibaraki-ken (JP); Hiroshi Watanabe, Ushiku (JP); Hiroshi Ogura, Ryugasaki (JP); Sadahisa Tomita, Ibaraki-ken (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/857,066

(22) PCT Filed: Sep. 29, 2000

(86) PCT No.: PCT/JP00/06763

§ 371 (c)(1),
(2), (4) Date: May 31, 2001

(87) PCT Pub. No.: WO01/25549

PCT Pub. Date: Apr. 12, 2001

(30) Foreign Application Priority Data

Oct. 1, 1999 (JP) ..... 11-281104

(51) Int. Cl.[7] ..... E02F 9/20

(52) U.S. Cl. ..... 701/50; 701/35; 37/234; 37/348; 340/500; 340/679; 340/686

(58) Field of Search ..... 701/50, 35; 37/234, 37/348, 414, 2; 172/4.5, 5, 6; 340/686, 500, 679, 684

(56) References Cited

U.S. PATENT DOCUMENTS 5,701,691 A 12/1997 Watanabe et al. ..... 37/348
5,752,333 A 5/1998 Nakagawa et al. ..... 37/348

FOREIGN PATENT DOCUMENTS

| | | |
|---|---|---|
| CN | 12-16080 A | 5/1999 |
| EP | 902131 | 3/1999 |
| JP | 62-185932 | 8/1987 |
| JP | 4-106229 | 4/1992 |
| JP | 5-287782 | 11/1993 |
| JP | 6-272282 | 9/1994 |
| JP | 8-246493 | 9/1996 |
| JP | 9-53253 | 2/1997 |
| WO | WO9836131 | 8/1998 |

*Primary Examiner*—William A. Cuchlinski, Jr.
*Assistant Examiner*—Marthe Y. Marc-Coleman
(74) *Attorney, Agent, or Firm*—Mattingly, Stanger & Malur, P.C.

(57) ABSTRACT

A setting/display processing section 11 of a control unit 9 comprises means 11*b*, 11*c* and 11*d* for computing the positional relationships among a machine body, an external reference and a target excavating surface by using a signal from a setting device 7 and signals supplied from angle sensors 8*a*, 8*b* when a front device is in a predetermined positional relationship relative to a laser reference surface, and means 11*e*, 11*f*, 11*g*, 11*h* and 11*j* for executing picture processing by using the computed positional relationships, and then producing and outputting picture signals to display the positional relationships among the body, the external reference and the target excavating surface. A display device 12 displays an illustration of the body and lines representing respectively the external reference and the target excavating surface on a display section 20 in accordance with the computed positional relationships. As a result, when carrying out excavation continuously over a long distance along a surface at a predetermined depth, a target excavating surface can be easily set using an external reference and a setting error relative to the external reference is less apt to occur.

11 Claims, 21 Drawing Sheets

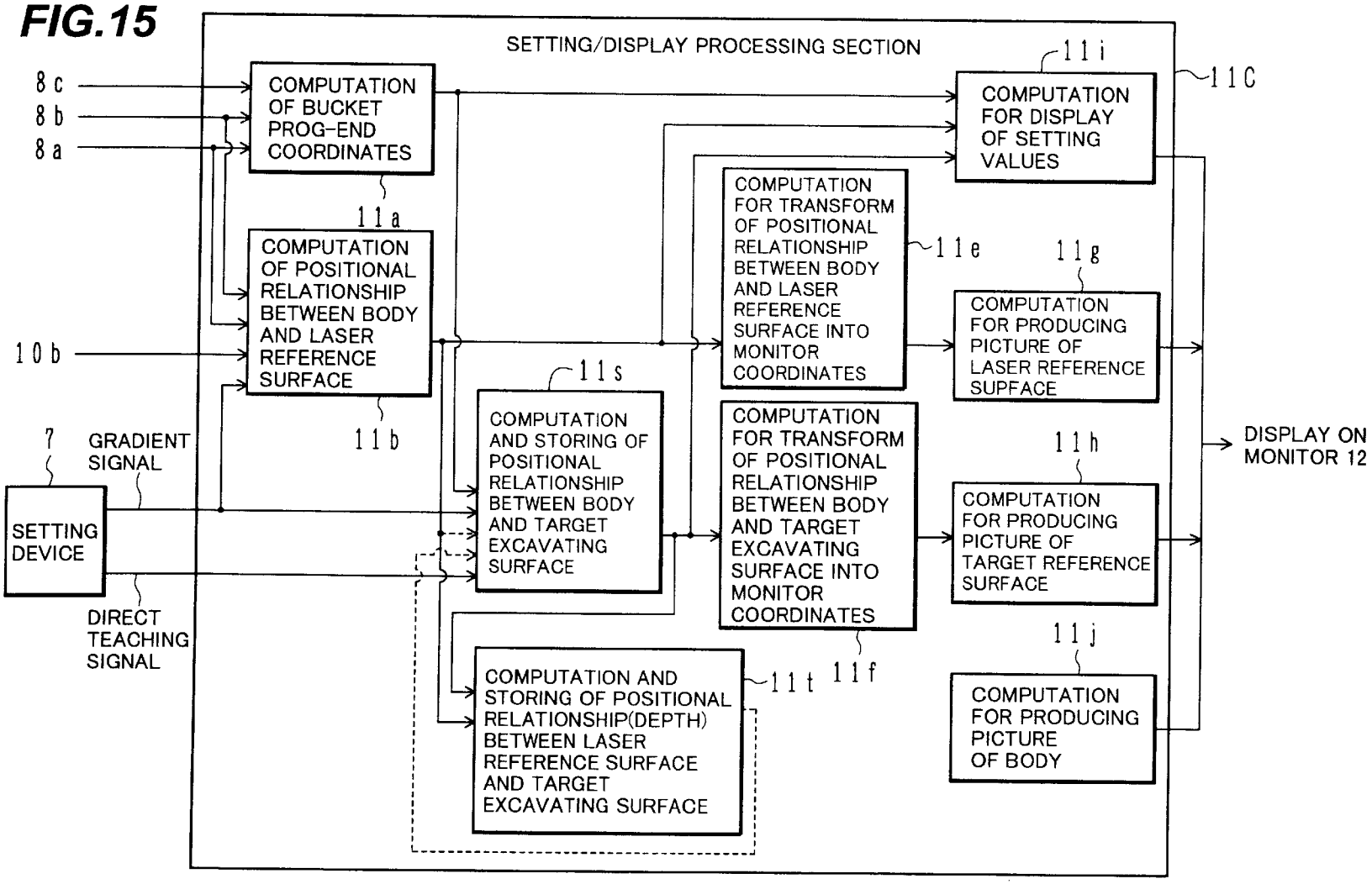
FIG.15
8c
8b
8a
10b
7
GRADIENT SIGNAL
SETTING DEVICE
DIRECT TEACHING SIGNAL
SETTING/DISPLAY PROCESSING SECTION
11a
COMPUTATION OF BUCKET PROG-END COORDINATES
11b
COMPUTATION OF POSITIONAL RELATIONSHIP BETWEEN BODY AND LASER REFERENCE SURFACE
11s
COMPUTATION AND STORING OF POSITIONAL RELATIONSHIP BETWEEN BODY AND TARGET EXCAVATING SURFACE
11e
COMPUTATION FOR TRANSFORM OF POSITIONAL RELATIONSHIP BETWEEN BODY AND LASER REFERENCE SURFACE INTO MONITOR COORDINATES
11f
COMPUTATION FOR TRANSFORM OF POSITIONAL RELATIONSHIP BETWEEN BODY AND TARGET EXCAVATING SURFACE INTO MONITOR COORDINATES
11t
COMPUTATION AND STORING OF POSITIONAL RELATIONSHIP(DEPTH) BETWEEN LASER REFERENCE SURFACE AND TARGET EXCAVATING SURFACE
11i
COMPUTATION FOR DISPLAY OF SETTING VALUES
11g
COMPUTATION FOR PRODUCING PICTURE OF LASER REFERENCE SUPFACE
11h
COMPUTATION FOR PRODUCING PICTURE OF TARGET REFERENCE SURFACE
11j
COMPUTATION FOR PRODUCING PICTURE OF BODY
11C
DISPLAY ON MONITOR 12

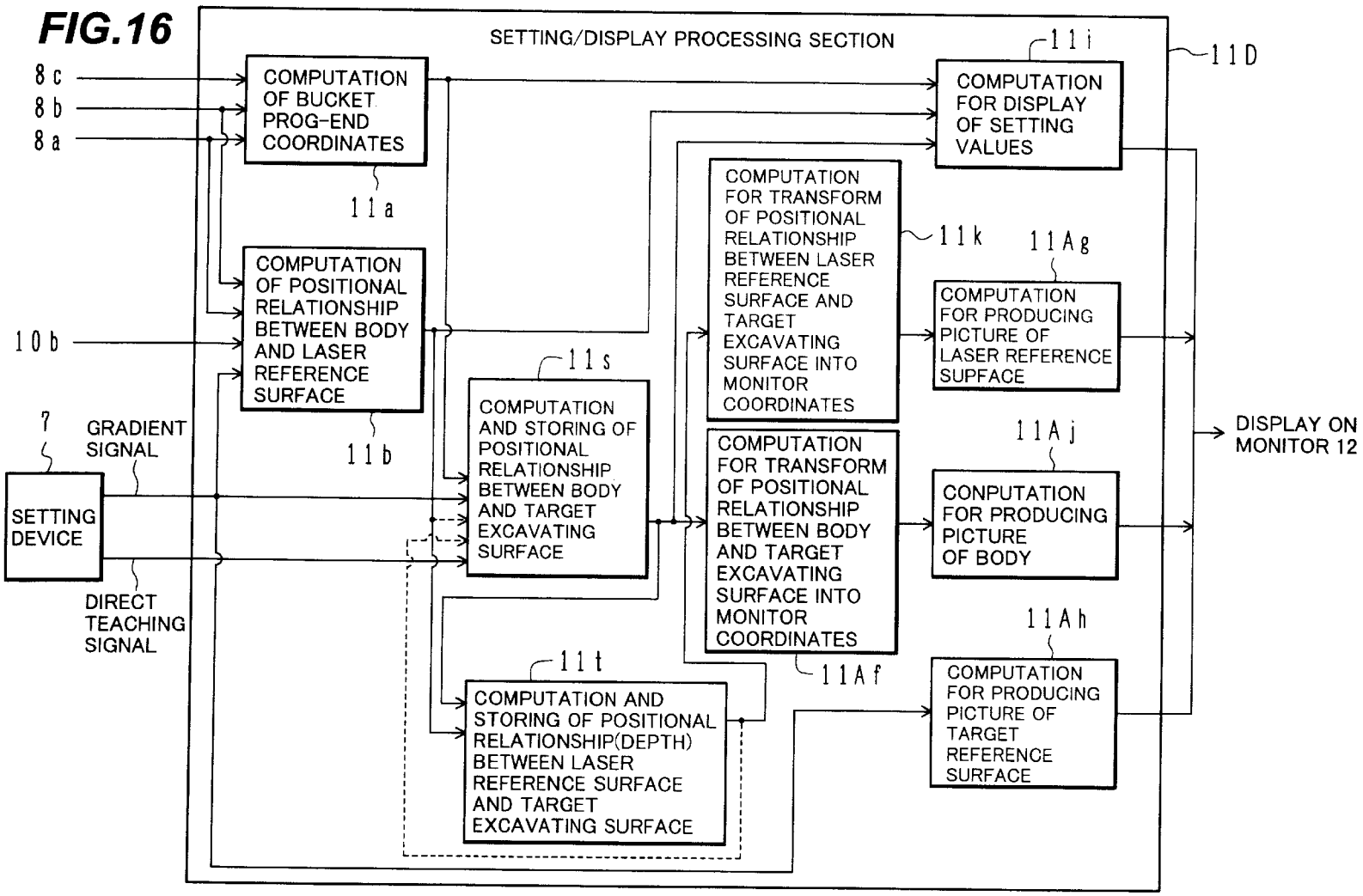
FIG.16
8c
8b
8a
10b
7
GRADIENT SIGNAL
SETTING DEVICE
DIRECT TEACHING SIGNAL
SETTING/DISPLAY PROCESSING SECTION
11D
DISPLAY ON MONITOR 12
COMPUTATION OF BUCKET PROG-END COORDINATES
11a
COMPUTATION OF POSITIONAL RELATIONSHIP BETWEEN BODY AND LASER REFERENCE SURFACE
11b
COMPUTATION AND STORING OF POSITIONAL RELATIONSHIP BETWEEN BODY AND TARGET EXCAVATING SURFACE
11s
COMPUTATION AND STORING OF POSITIONAL RELATIONSHIP(DEPTH) BETWEEN LASER REFERENCE SURFACE AND TARGET EXCAVATING SURFACE
11t
COMPUTATION FOR TRANSFORM OF POSITIONAL RELATIONSHIP BETWEEN LASER REFERENCE SURFACE AND TARGET EXCAVATING SURFACE INTO MONITOR COORDINATES
11k
COMPUTATION FOR TRANSFORM OF POSITIONAL RELATIONSHIP BETWEEN BODY AND TARGET EXCAVATING SURFACE INTO MONITOR COORDINATES
11Af
COMPUTATION FOR DISPLAY OF SETTING VALUES
11i
COMPUTATION FOR PRODUCING PICTURE OF LASER REFERENCE SUPFACE
11Ag
CONPUTATION FOR PRODUCING PICTURE OF BODY
11Aj
COMPUTATION FOR PRODUCING PICTURE OF TARGET REFERENCE SURFACE
11Ah

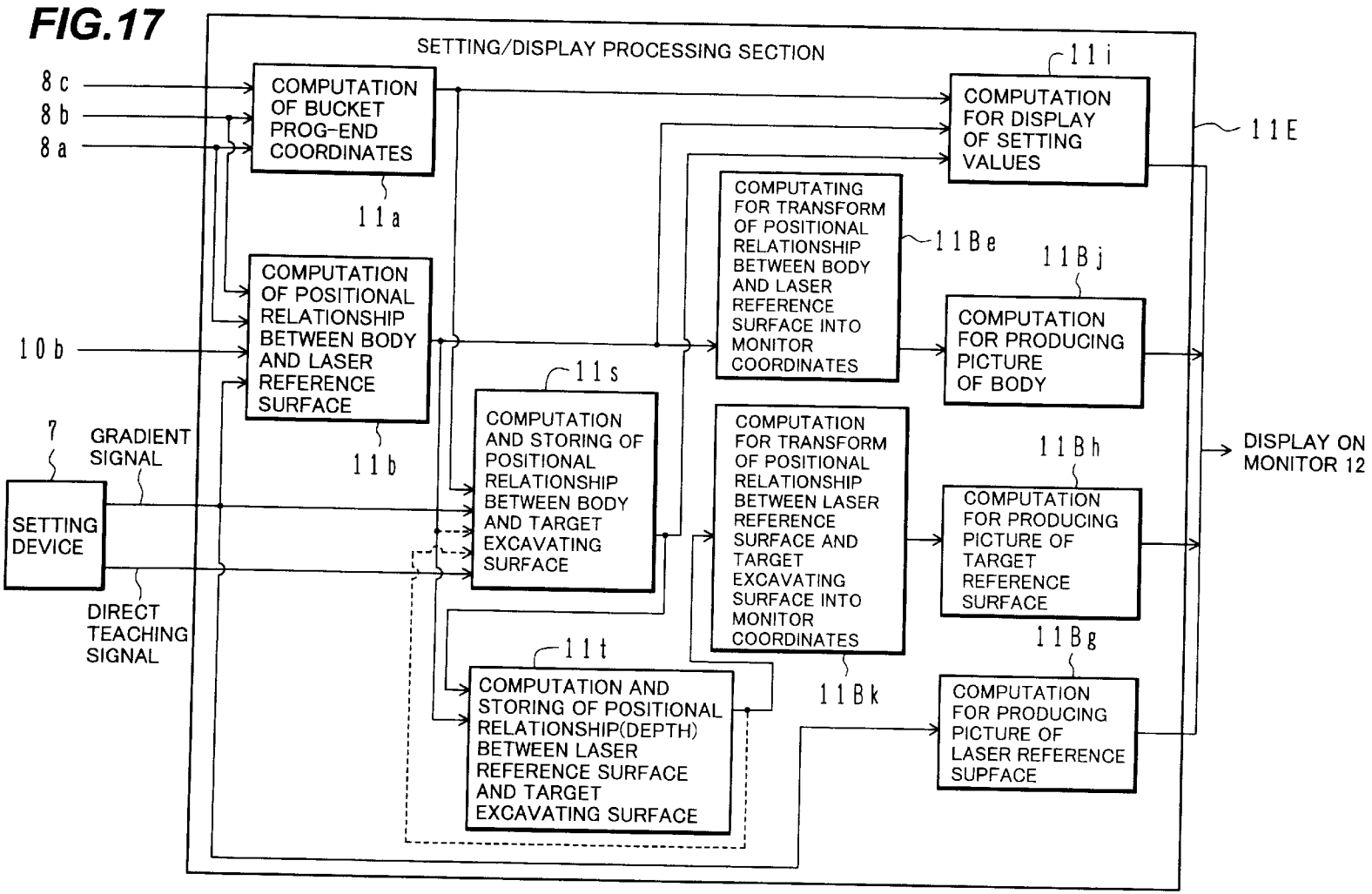
FIG.17
SETTING/DISPLAY PROCESSING SECTION
11E
DISPLAY ON MONITOR 12
11i
COMPUTATION FOR DISPLAY OF SETTING VALUES
11Bj
COMPUTATION FOR PRODUCING PICTURE OF BODY
11Bh
COMPUTATION FOR PRODUCING PICTURE OF TARGET REFERENCE SURFACE
11Bg
COMPUTATION FOR PRODUCING PICTURE OF LASER REFERENCE SUPFACE
11Be
COMPUTATING FOR TRANSFORM OF POSITIONAL RELATIONSHIP BETWEEN BODY AND LASER REFERENCE SURFACE INTO MONITOR COORDINATES
COMPUTATION FOR TRANSFORM OF POSITIONAL RELATIONSHIP BETWEEN LASER REFERENCE SURFACE AND TARGET EXCAVATING SURFACE INTO MONITOR COORDINATES
11Bk
11s
COMPUTATION AND STORING OF POSITIONAL RELATIONSHIP BETWEEN BODY AND TARGET EXCAVATING SURFACE
11t
COMPUTATION AND STORING OF POSITIONAL RELATIONSHIP(DEPTH) BETWEEN LASER REFERENCE SURFACE AND TARGET EXCAVATING SURFACE
11a
COMPUTATION OF BUCKET PROG-END COORDINATES
11b
COMPUTATION OF POSITIONAL RELATIONSHIP BETWEEN BODY AND LASER REFERENCE SURFACE
8c
8b
8a
10b
7
GRADIENT SIGNAL
DIRECT TEACHING SIGNAL
SETTING DEVICE

TARGET EXCAVATION SURFACE SETTING DEVICE FOR EXCAVATION MACHINE, RECORDING MEDIUM THEREFOR AND DISPLAY UNIT

TECHNICAL FIELD

The present invention relates to a target excavating-surface setting system for an excavating machine, such as a hydraulic excavator, which is employed to set work conditions of the excavating machine, a storage medium storing a target excavating-surface setting program for an excavating machine, and a display device for use in the target excavating-surface setting system.

BACKGROUND ART

In a hydraulic excavator, an operator operates front members, such as a boom, by associated manual control levers. There is however a difficulty for the operator to judge whether or not excavation is carried out precisely along a ditch at a predetermined depth or a slope at a predetermined gradient, just by visually observing the front operation. It is therefore known to set the depth of an excavating surface or the gradient of a slope beforehand, and to perform automatic excavation control so that the set depth or gradient is achieved. A target excavating surface must be set to perform the automatic excavation control. A monitoring apparatus for an excavating machine disclosed in JP,A 62-185932 and an excavating machine disclosed in JP,A 5-287782 are proposed as employing a two-dimensional display device for setting a target excavating surface.

In the excavating machines disclosed in JP,A 62-185932 and JP,A 5-287782, a machine body and a target excavating surface are displayed in the form of pictures on a monitor, and a depth from the machine body to the target excavating surface or a gradient of the target excavating surface is also displayed on the monitor.

Further, an excavation area setting system for area limiting excavation control in construction machines, disclosed in, e.g., JP,A 9-53253, proposes a system in which an external reference, such as a leveling string or a laser reference surface formed by a laser lighthouse installed outside a machine body, is used in combination with a hydraulic excavator, and excavation is carried out continuously over a long distance along a surface at a certain depth or gradient relative to the external reference.

In the excavation area setting system disclosed in JP,A 9-53253, a laser beam receiver is attached to a front member, and a vertical shift upon travel of the machine body is compensated for with the aid of a laser beam so that a continuous linear excavating surface is obtained. Also, in that excavation area setting system, the relationship between the machine body and a target excavating surface is set by setting the target excavating surface relative to the laser reference surface.

DISCLOSURE OF THE INVENTION

In the excavating machines disclosed in JP,A 62-185932 and JP,A 5-287782, however, any external reference is not used. This means that display of an external reference is neither provided nor intended.

Also, the excavation area setting system disclosed in JP,A 9-53253 has a problem that a setting error is apt to occur because the depth, set by a setting device, from the laser reference surface (external reference) to the target excavating surface is displayed just in the form of a numerical value on the monitor.

More specifically, in a system employing a laser reference surface (external reference), excavation is carried out continuously over a long distance along a surface at a predetermined depth from the external reference such as the laser reference surface and, to this end, setting of a target excavating surface must be repeated using the external reference. In order to realize precise setting, therefore, it is required that the operator can confirm and recognize not only the positional relationship between a machine body and the target excavating surface, but also the positional relationship between the laser reference surface and the target excavating surface. In the conventional system wherein only a numerical value or only the positional relationship between the machine body and the target excavating surface is displayed, it is difficult for the operator to visually recognize the positional relationship between the laser reference surface and the target excavating surface, and hence a setting error is apt to occur.

An object of the present invention is to provide a target excavating-surface setting system for an excavating machine, which can easily set a target excavating surface using an external reference when excavation is carried out continuously over a long distance along a surface at a predetermined depth, and which is less apt to cause a setting error relative to the external reference, as well as to a storage medium and a display device for use in the target excavating-surface setting system.

(1) To achieve the above object, the present invention provides a target excavating-surface setting system for an excavating machine, in which a target excavating surface is set parallel to an external reference installed outside a machine body and a front device is controlled for the target excavating surface, thereby carrying out excavation continuously along the target excavating surface, wherein the system comprises input means for setting the target excavating surface; detecting means for detecting status variables relating to a position and a posture of the front device; first computing means for computing positional relationships among the body, the external reference and the target excavating surface by using signals from the input means and the detecting means; and second computing means for executing picture processing by using the positional relationships computed by the first computing means, and producing and outputting picture signals to display the positional relationships among the body, the external reference and the target excavating surface.

With the features set forth above, the positional relationships among the external reference, the target excavating surface and the body are displayed on image display means. By looking at the display, therefore, an operator can visually confirm and recognize non only the positional relationship between the body and the target excavating surface, but also the positional relationship between the external reference and the target excavating surface, and can ascertain whether the setting conditions are proper or not. As a result, the target excavating surface can be easily set using the external reference when excavation is carried out continuously over a long distance until and along a surface at a predetermined depth and a setting error is less apt to occur.

(2) In the above (1), preferably, the first computing means comprises first means for computing the positional relationship of the body relative to the external reference by using the signals from the detecting means; and second means for computing the positional relationship between the external reference and the target excavating surface by using at least the signals from the input means.

(3) Also, in the above (1), preferably, the input means includes numerical value input means for inputting a depth from the external reference to the target excavating surface, and the first computing means comprises third computing means for computing the positional relationship between the body and the external reference by using the signals supplied from the detecting means when the front device is in a predetermined positional relationship relative to the external reference; and first setting means for setting the positional relationship between the external reference and the target excavating surface by using the signals from the numerical value input means.

(4) In the above (3), preferably, the first computing means further comprises fourth computing means for computing the positional relationship between the body and the target excavating surface by using values computed by the third computing means and a value set by the first setting means, and the second computing means comprises first transforming means for executing processing to transform the values computed by the third computing means into values on a monitor coordinate system set for a display section of a display device on the basis of the body, and to display the positional relationship between the body and the external reference on the display section; and second transforming means for executing processing to transform values computed by the fourth computing means into values on the monitor coordinate system on the basis of the body, and to display the positional relationship between the body and the target excavating surface on the display section.

(5) Further, in the above (1), the input means may include direct-teaching instructing means operated when a work implement provided as the front device is at a predetermined depth. In this case, the first computing means comprises fourth computing means for computing the positional relationship between the body and the target excavating surface by using the signals supplied from the detecting means when the direct-teaching instructing means is operated; fifth computing means for computing the positional relationship between the body and the external reference by using the signals supplied from the detecting means when the front device is in a predetermined positional relationship relative to the external reference; and sixth computing means for computing the positional relationship between the external reference and the target excavating surface by using values computed by the fourth and fifth computing means.

(6) In the above (5), preferably, the first computing means further comprises seventh computing means for computing the positional relationship between the body and the target excavating surface by using values computed by the fifth and sixth computing means, and the second computing means comprises first transforming means for executing processing to transform the values computed by the fifth computing means into values on a monitor coordinate system set for a display section of a display device on the basis of the body, and to display the positional relationship between the body and the external reference on the display section; and second transforming means for executing processing to transform the values computed by the fourth computing means or the seventh computing means into values on the monitor coordinate system on the basis of the body, and to display the positional relationship between the body and the target excavating surface on the display section.

(7) Further, in the above (1), preferably, the input means includes means for setting a gradient of the external reference, the first computing means computes the positional relationships among the body, the external reference and the target excavating surface, including a set value of the gradient, and the second computing means produces the picture signals for displaying the external reference and the target excavating surface depending on the gradient.

(8) Still further, in the above (1), the target excavating-surface setting system further comprises a display device for displaying, in accordance with the computed positional relationships, a picture representing the body and straight lines representing respectively the external reference and the target excavating surface by using the picture signals outputted from the second computing means.

(9) Still further, in the above (1), preferably, the first computing means is disposed in a first control unit, and the second computing means is disposed in a second control unit separate from the first control unit.

(10) To achieve the above object, the present invention also provides a storage medium storing a target excavating-surface setting program for an excavating machine, in which a target excavating surface is set parallel to an external reference installed outside a machine body and a front device is controlled for the target excavating surface, thereby carrying out excavation continuously along the target excavating surface, wherein the program operates a computer to execute the steps of computing positional relationships among the body, the external reference and the target excavating surface by using a signal from input means for setting the target excavating surface and signals from detecting means for detecting status variables relating to a position and a posture of the front device; and executing picture processing by using the computed positional relationships for producing and outputting picture signals to display the positional relationships among the body, the external reference and the target excavating surface.

(11) To achieve the above object, the present invention further provides a display device for use in a target excavating-surface setting program for an excavating machine, in which a target excavating surface is set parallel to an external reference installed outside a machine body and a front device is controlled for the target excavating surface, thereby carrying out excavation continuously along the target excavating surface, wherein the display device comprises a display section for taking in picture signals representing previously computed positional relationships among the body, the external reference and the target excavating surface, and displaying a picture representing the body and straight lines representing respectively the external reference and the target excavating surface in accordance with the previously computed positional relationships.

BRIEF DESCRIPTION OF THE DRAWINGS

FIG. 15 is a block diagram showing processing functions of a setting/display processing section based on a direct teaching method, which are used in a target excavating-surface setting system for an excavating machine according to a fourth embodiment of the present invention.

FIG. 16 is a block diagram showing processing functions of a setting/display processing section based on the direct teaching method, which are used in a target excavating-surface setting system for an excavating machine according to a fifth embodiment of the present invention.

FIG. 17 is a block diagram showing processing functions of a setting/display processing section based on the direct teaching method, which are used in a target excavating-surface setting system for an excavating machine according to a sixth embodiment of the present invention.

BEST MODE FOR CARRYING OUT THE INVENTION

Embodiments of the present invention will be described below with reference to the drawings.

FIGS. 1 to 10 show a target excavating-surface setting system for an excavating machine according to a first embodiment of the present invention, including a display device for use therein. This embodiment represents the case where the present invention is applied to a hydraulic excavator.

Figure 1:
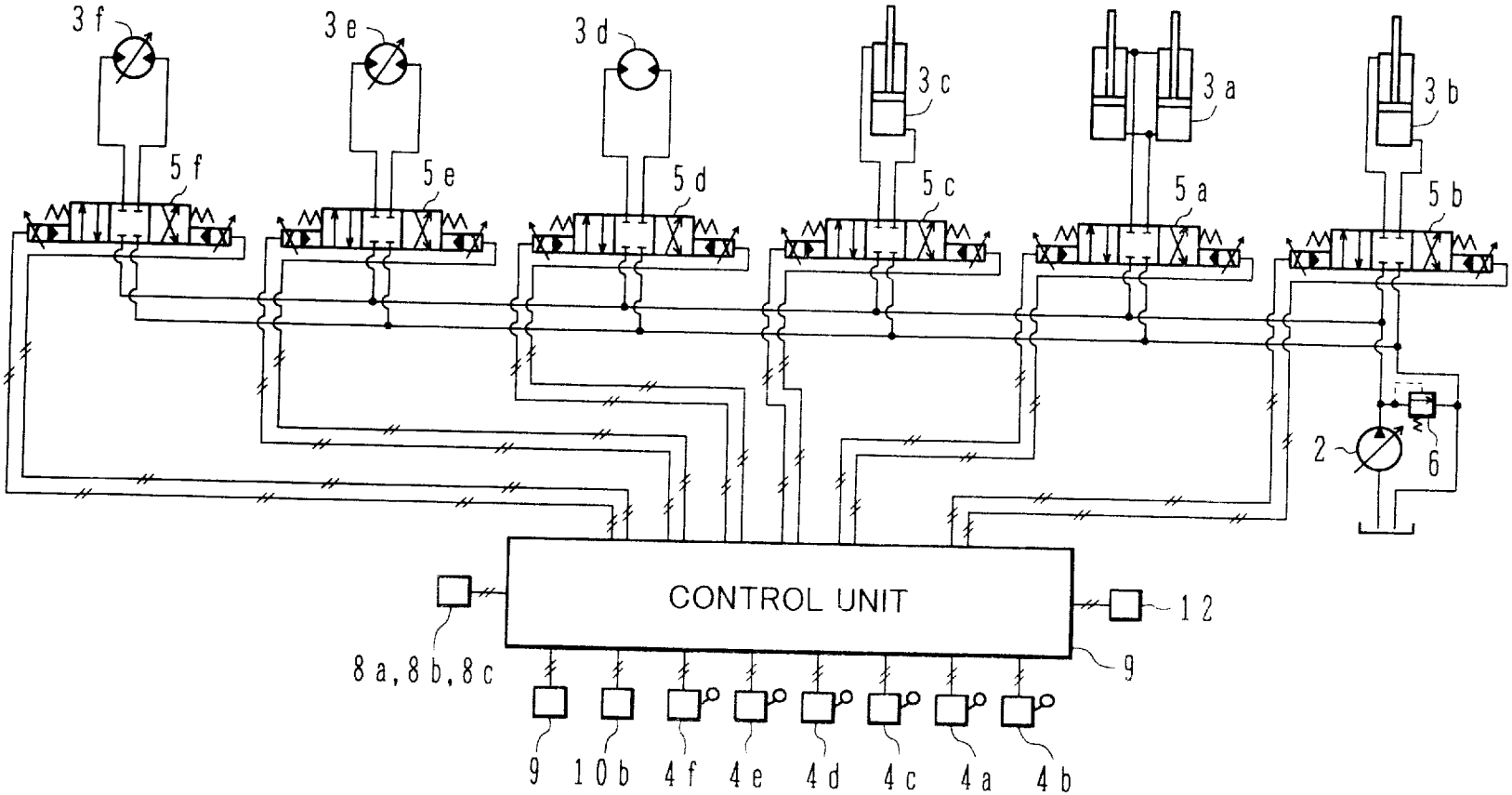
FIG. 1 is a diagram showing a target excavating-surface setting system for an excavating machine according to a first embodiment of the present invention, along with a hydraulic drive system of a hydraulic excavator.

In FIG. 1, the hydraulic excavator comprises a hydraulic pump 2; a plurality of hydraulic actuators including a boom cylinder 3*a*, an arm cylinder 3*b*, a bucket cylinder 3*c*, a swing motor 3*d* and left and right travel motors 3*e*, 3*f*, which are driven by a hydraulic fluid from the hydraulic pump 2; a plurality of control lever units 4*a*–4*f* provided respectively corresponding to the hydraulic actuators 3*a*–3*f*; a plurality of flow control valves 5*a*–5*f* controlled by the plurality of control lever units 4*a*–4*f* and controlling respective flow rates of the hydraulic fluid supplied to the hydraulic actuators 3*a*–3*f*; a relief valve 6 which is opened when the delivery pressure of the hydraulic pump 2 exceeds a preset value; and a control unit 9 for receiving operational signals from the control lever units 4*a*–4*f* and controlling the flow control valves 5*a*–5*f*. These components constitute a hydraulic drive system for driving driven members of the hydraulic excavator.

In this embodiment, the control lever units 4*a*–4*f* are electrical lever units for outputting electrical signals as the operational signals, and the flow control valves 5*a*–5*f* are electro-hydraulic converting means for converting the electrical signals into pilot pressures, e.g., electrically or hydraulically operated valves each having proportional solenoid valves provided at opposite ends. The control unit 9 receives the operational signals from the control lever units 4*a*–4*f* and produces flow-control-valve driving signals corresponding to the received signals, thereby driving and controlling the flow control valves 5*a*–5*f*.

Figure 2:
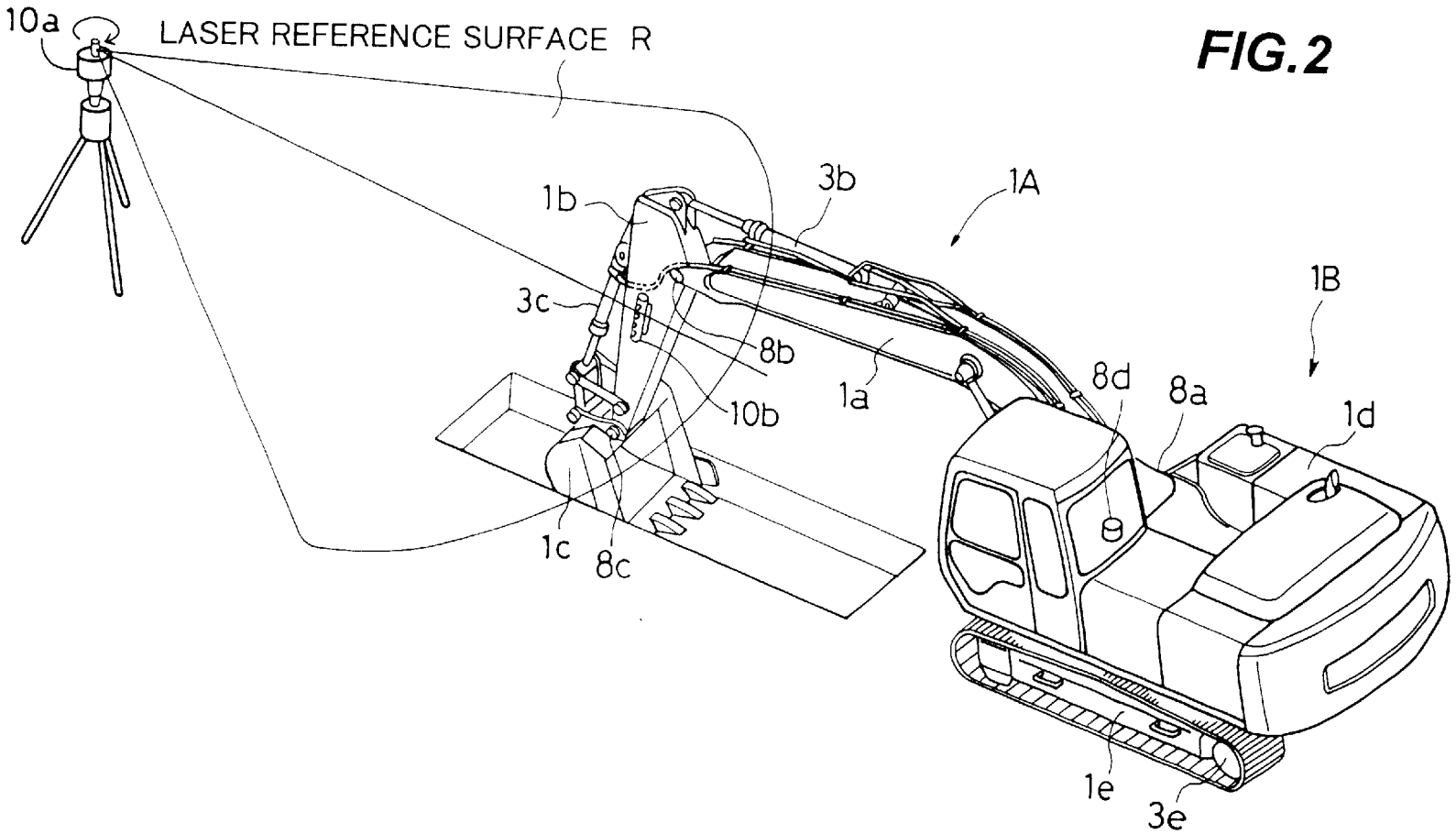
FIG. 2 is a view showing an external appearance of a hydraulic excavator to which the present invention is applied, along with a laser lighthouse and a laser reference surface formed by the laser lighthouse.

As shown in FIG. 2, the hydraulic excavator is made up of a multi-articulated front device 1A comprising a boom 1*a*, an arm 1*b* and a bucket (work implement) 1*c* which are each rotatable in the vertical direction, and a machine body 1B comprising an upper swing structure 1*d* and a lower travel structure 1*e*. The boom 1*a* of the front device 1A is supported at its base end to a front portion of the upper swing structure 1*d*.

The boom 1*a*, the arm 1*b*, the bucket 1*c*, the upper swing structure 1*d*, and the lower travel structure 1*e*, shown in FIG. 2, are driven respectively by the boom cylinder 3*a*, the arm cylinder 3*b*, the bucket cylinder 3*c*, the swing motor 3*d*, and the left and right travel motors 3*e*, 3*f* shown in FIG. 1. The operations of these members are instructed by the control lever units 4*a*–4*f*.

The target excavating-surface setting system according to this embodiment is installed in the hydraulic excavator constructed as described above. The target excavating-surface setting system comprises a setting device 7 used for setting a target excavating surface that should be linearly finished; angle sensors 8*a*, 8*b* and 8*c* provided at pivots about which the boom 1*a*, the arm 1*b* and the bucket 1*c* are rotated, respectively, and detecting rotational angles of the boom 1*a*, the arm 1*b* and the bucket 1*c* as status variables relating to the position and the posture of the front device 1A; a laser beam receiver 10*b* attached to a lateral surface of the arm 1*b* and receiving a laser beam formed by the laser lighthouse 10*a* installed outside the body; a two-dimensional display monitor (display device) 12 mounted within a cab at a corner obliquely in front of an operator seat; and later-described processing functions incorporated in the control unit 9. The laser beam formed by the laser lighthouse 10*a* provides a laser reference surface (external reference) R.

Figure 3:
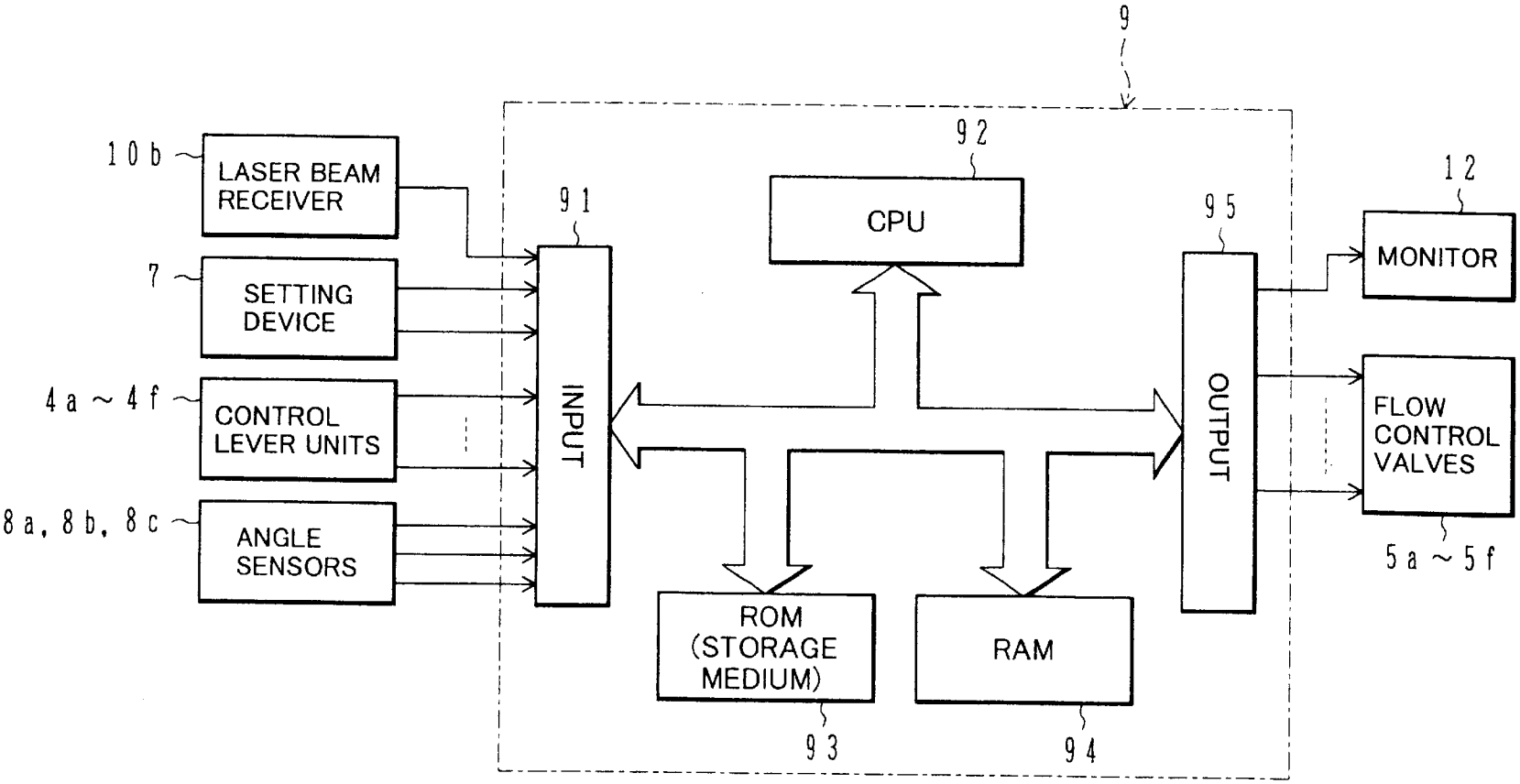
FIG. 3 is a diagram showing the target excavating-surface setting system in FIG. 1, along with a hardware configuration of a control unit.

FIG. 3 shows a hardware configuration of the control unit 9. The control unit 9 comprises an input section 91, a central processing unit (CPU) 92 constituted by a microcomputer, a read only memory (ROM) 93, a random access memory (RAM) 94, and an output section 95. The input section 91 receives operational signals from the control lever units 4*a*–4*f*, instruction signals (setting signal and main switch signal) from the setting device 7, angle signals from the angle sensors 8*a*, 8*b* and 8*c*, and a laser beam input signal from the laser beam receiver 10*b*, and then executes A/D conversion of those signals. The ROM 93 is a storage medium in which a control program (described below) is stored. The CPU 92 executes predetermined processing of the signals taken in through the input section 91 in accordance with the control program stored in the ROM 93. The RAM 94 temporarily stores numerical values used in computation. The output section 95 produces output signals depending on processing results of the CPU 92, outputs the produced signals to the flow control valves 5*a*–5*f*, and displays the body 1B, the laser reference surface R and the target excavating surface on the monitor 12.

Figure 4:
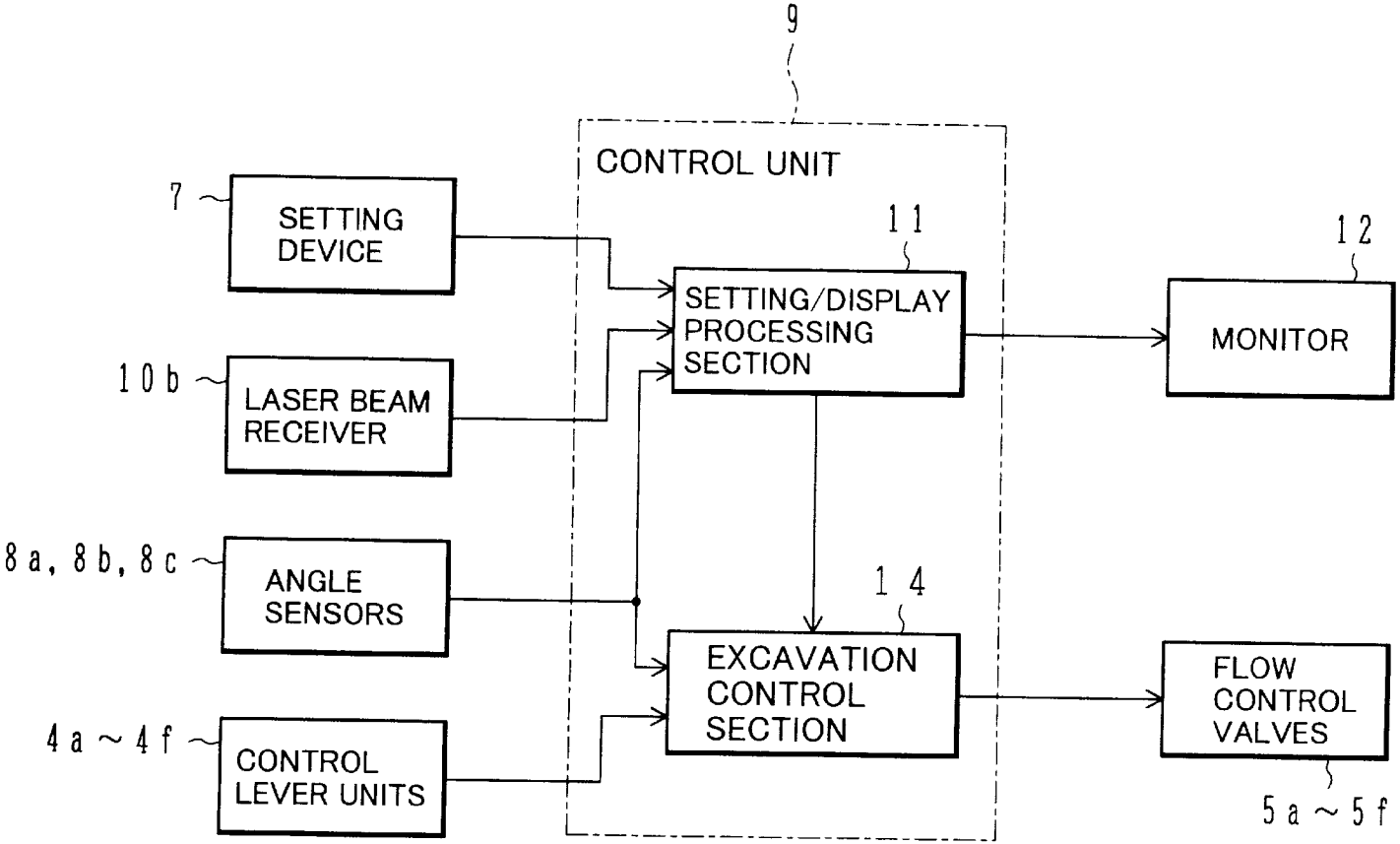
FIG. 4 is a diagram showing the target excavating-surface setting system in FIG. 1, along with processing functions of the control unit.

FIG. 4 is a functional block diagram showing outline of the control program stored in the ROM 93 of the control unit 9. The control unit 9 comprises a setting/display processing section 11 for setting the target excavating surface and executing processing for display on the monitor 12, and an excavation control section 14 for carrying out area limiting excavation control.

The setting/display processing section 11 receives the detection signals from the angle sensors 8*a*, 8*b* and 8*c*, the signal from the setting device 7 and the signal from the laser beam receiver 10*b*, and computes the target excavating surface and the laser reference surface based on the x-z coordinate system (described later) set for the body 1B of the hydraulic excavator, thereby setting the target excavating surface. Also, the setting/display processing section 11 executes a combining process for executing coordinate transform of the target excavating surface and the laser reference surface into values on the $x_m$–$z_m$ coordinate system (described later) that is fixedly set for an illustration of the hydraulic excavator displayed on the two-dimensional display monitor 12, and then displaying both the target excavating surface and the laser reference surface in a superimposed relation to the illustration of the hydraulic excavator. Further, the setting/display processing section 11 executes a combining process for displaying numerical values such as data representing the distance between the target excavating surface and the laser reference surface, the gradient thereof, and the distance from the laser reference surface to the bucket in the depth direction.

The excavation control section 14 executes processing to create command signals for the flow control valves 5*a*–$\mathbf{5}_f$ so as to carry out known area limiting excavation control in accordance with the target excavating surface set by the setting/display processing section 11.

Figure 5:
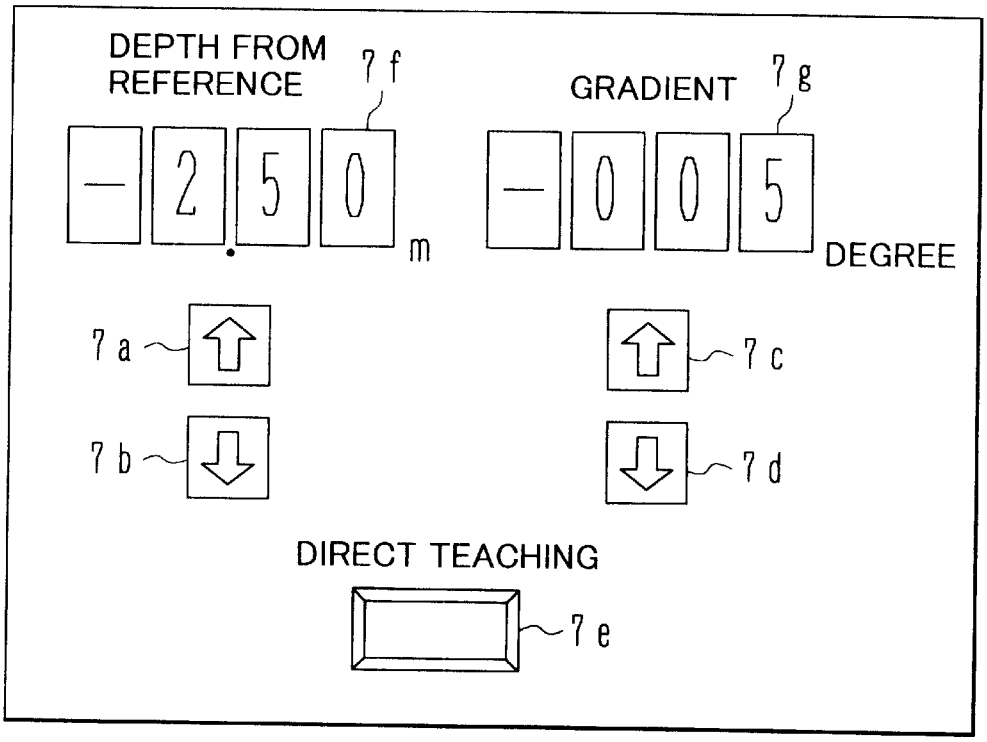
FIG. 5 is a representation showing a construction of a setting device in FIG. 1.

The setting device 7 comprises, as shown in FIG. 5, operating means, e.g., switches disposed on a control panel or a grip, and indicators 7*f*, 7*g*, the switches including an up-key 7*a* and a down-key 7*b* for setting the depth from the laser reference surface R, an up-key 7*c* and a down-key 7*d* for setting the gradient, and a direct teaching button 7*e*. In the case of using a method of inputting numerical values, the depth from the laser reference surface R can be set by operating the up-key 7*a* and the down-key 7*b*, and the setting result is indicated on the indicator 7*f*. In the case of using a direct teaching method, when the direct teaching button 7*e* is operated, the target excavating surface relative to the body 1B at that time is computed and set, and the bucket position relative to the laser reference surface R is computed and set as the depth from the laser reference surface. Also, in either case, the gradient of the laser reference surface and the target excavating surface can be set by operating the up-key 7*c* or the down-key 7*d*, and the setting result is indicated on the indicator 7*g*. The setting device 7 outputs, to the setting/display processing section 11, a direct teaching signal, an excavating depth signal and a gradient signal, which are related to the excavating surface and entered by the operator.

The processing functions of the setting/display processing section 11 will now be described with reference to FIG. 6. These processing functions correspond to the method of inputting numerical values and to the case where transform into monitor coordinates is carried out on the basis of the body 1B of the hydraulic excavator.

Figure 6:
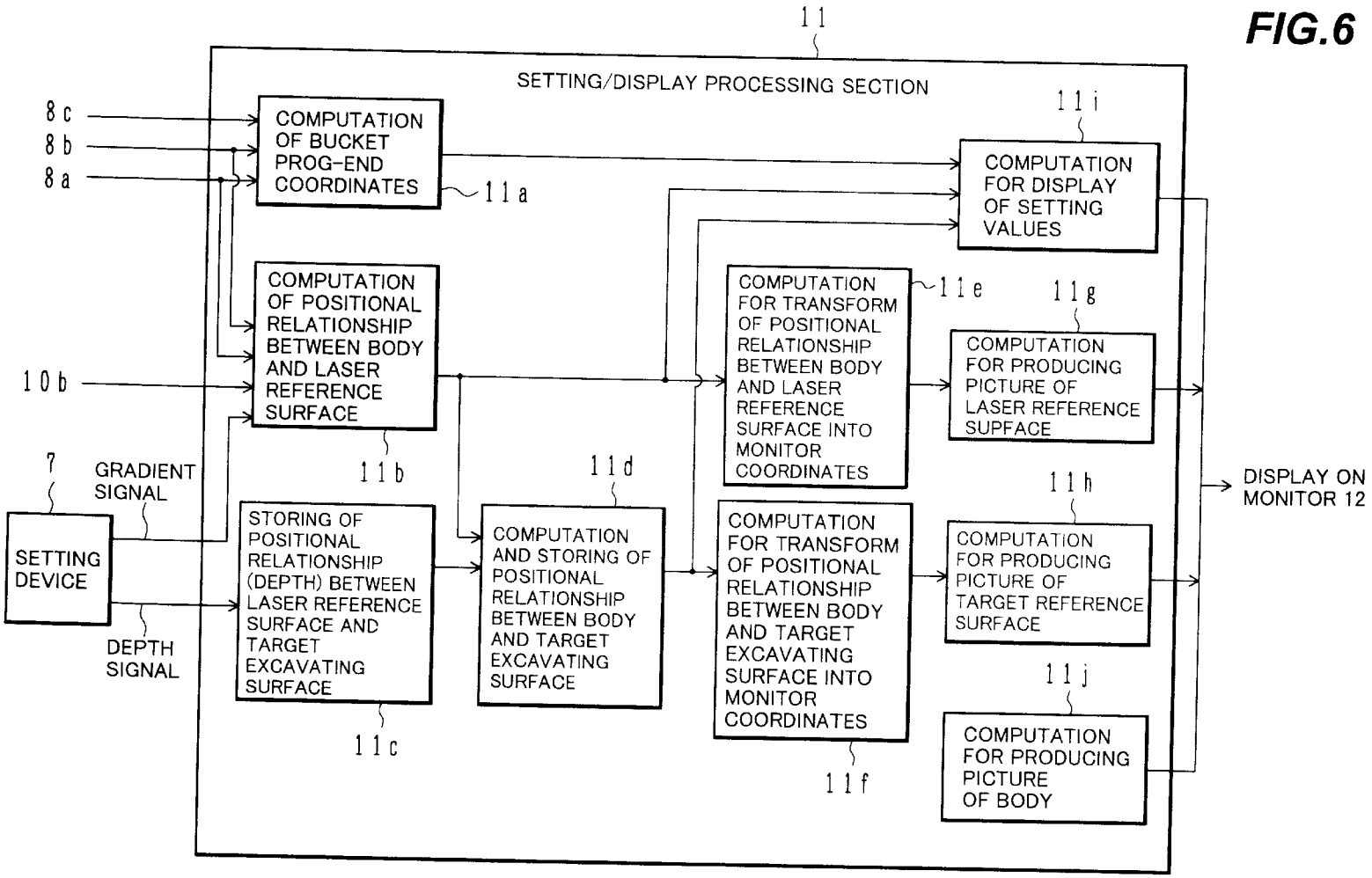
FIG. 6 is a block diagram showing processing functions of a setting/display processing section, shown in FIG. 4, based on a method of inputting numerical values.

FIG. 6 represents, in the form of a block diagram, the processing functions of the setting/display processing section 11. The setting/display processing section 11 includes various functions executed by a section 11*a* for computing bucket prong-end coordinates; a section 11*b* for computing the positional relationship between the body and the laser reference surface; a section 11*c* for storing the positional relationship (depth) between the laser reference surface and the target excavating surface; a section 11*d* for computing and storing the positional relationship between the body and the target excavating surface; a computing section 11*e* for transform of the positional relationship between the body and the laser reference surface into monitor coordinates; a computing section 11*f* for transform of the positional relationship between the body and the target excavating surface into monitor coordinates; a computing section 11*g* for producing a picture of the laser reference surface; a computing section 11*h* for producing a picture of the target excavating surface; a computing section 11*i* for display of the setting values; and a computing section 11*j* for producing a picture of the body.

Figure 7:
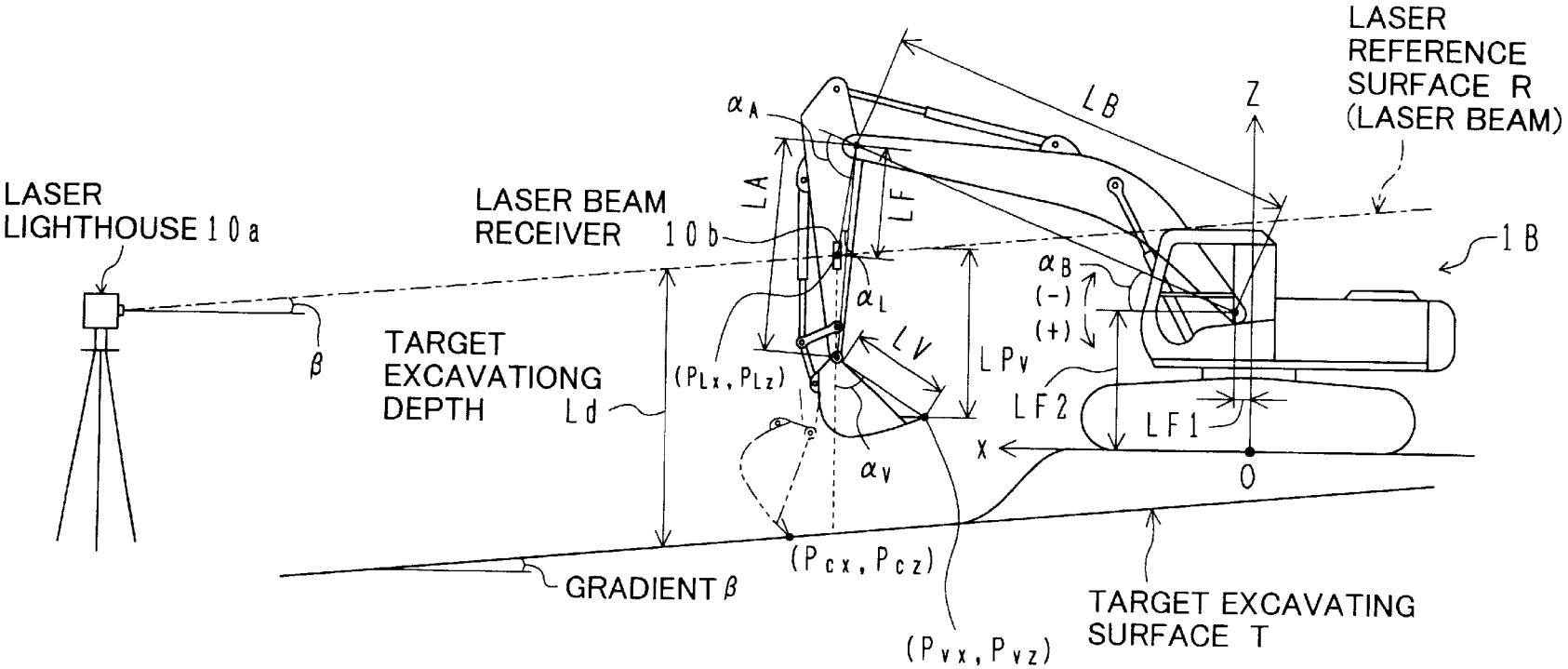
FIG. 7 is an explanatory view showing dimensions of components of the hydraulic excavator to which the target excavating-surface setting system for the excavating machine according to the present invention is applied, a coordinate system used, and the relationship among a machine body, a laser reference surface and a target excavating surface.

The section 11*a* for computing bucket prong-end coordinates computes, on the basis of the x-z coordinate system set for the body 1B and the dimensions of the respective components shown in FIG. 7, as well as of the detection signals from the angle sensors 8*a*, 8*b* and 8*c*, coordinate values (Pvx, Pvz) of the bucket prong end on the x-z coordinate system from the following formulae (1) and (2)

$$Pvx=LV\times\cos(\alpha B+\alpha A+\alpha V)+LA\times\cos(\alpha B+\alpha A)+LB\times\cos\alpha B+LF1 \quad (1)$$

$$Pvz=-LV\times\sin(\alpha B+\alpha A+\alpha V)-LA\times\sin(\alpha B+\alpha A)-LB\times\sin\alpha B+LF2 \quad (2)$$

LV: bucket length (distance between bucket rotation center and bucket prong end)

LA: arm length (distance between arm rotation center and bucket rotation center)

LB: boom length (distance between boom rotation center and arm rotation center)

LF1: x-coordinate value of boom rotation center on x-z coordinate system

LF2: z-coordinate value of boom rotation center on x-z coordinate system

αB: boom rotational angle

αA: arm rotational angle

αV: bucket rotational angle

Herein, the x-z coordinate system is an orthogonal coordinate system with the origin set at a predetermined position of the body 1B of the hydraulic excavator, e.g., the center of a bottom surface of the body 1B. Also, the target excavating surface is denoted by T in FIG. 7.

The section 11*b* for computing the positional relationship between the body and the laser reference surface computes a linear equation of the laser reference surface R on the x-z coordinate system from both coordinate values (PLx, PLz) of the laser beam receiver 10*b* on the x-z coordinate system resulted when the laser beam receiver 10*b* receives the laser beam, and a gradient β set by the setting device 7.

Herein, the coordinate values (PLx, PLz) of the laser beam receiver 10*b* on the x-z coordinate system resulted when the laser beam receiver 10*b* receives the laser beam is computed from the following formulae (1A) and (2A), as with the above formulae (1) and (2), based on the dimensions of the respective components and the detection signals from the angle sensors 8*a*, 8*b*:

$$PLx=LF\times\cos(\alpha B+\alpha A-\alpha L)+LB\times\cos\alpha B+LF1 \quad (1A)$$

$$PLz=-LF\times\sin(\alpha B+\alpha A-\alpha L)+LB\times\sin\alpha B+LF2 \quad (2A)$$

LF: distance between arm rotation center and laser beam receiver 10*b*

αL: attachment angle of laser beam receiver relative to straight line connecting arm rotation center and bucket rotation center Also, since a linear equation of the laser reference surface R on the x-z coordinate system is represented by a straight line passing the coordinate values (PLx, PLz) and having the gradient β, it is expressed by the following formula (3):

$$z=\tan\beta\cdot x+(PLz-\tan\beta\cdot PLx) \quad (3)$$

The section 11*c* for storing the positional relationship (depth) between the laser reference surface and the target excavating surface stores a dept setting value Ld set by the setting device 7 relative to the laser reference surface R.

The section 11*d* for computing and storing the positional relationship between the body and the target excavating surface computes a linear equation of the target excavating surface T on the x-z coordinate system from the following formula (4) based on both the positional relationship between the body and the laser reference surface computed by the computing section 11*b* and the depth setting value Ld stored in the storing section 11*c*. Assuming, for example, that the linear equation of the laser reference surface R is expressed by z=tan β·x+(PLz−tan β·PLx) and the depth setting value is Ld, the linear equation of the target excavating surface T is expressed by:

$$z=\tan\beta\cdot x+(PLz-\tan\beta\cdot PLx)+Ld \quad (4)$$

Figure 8:
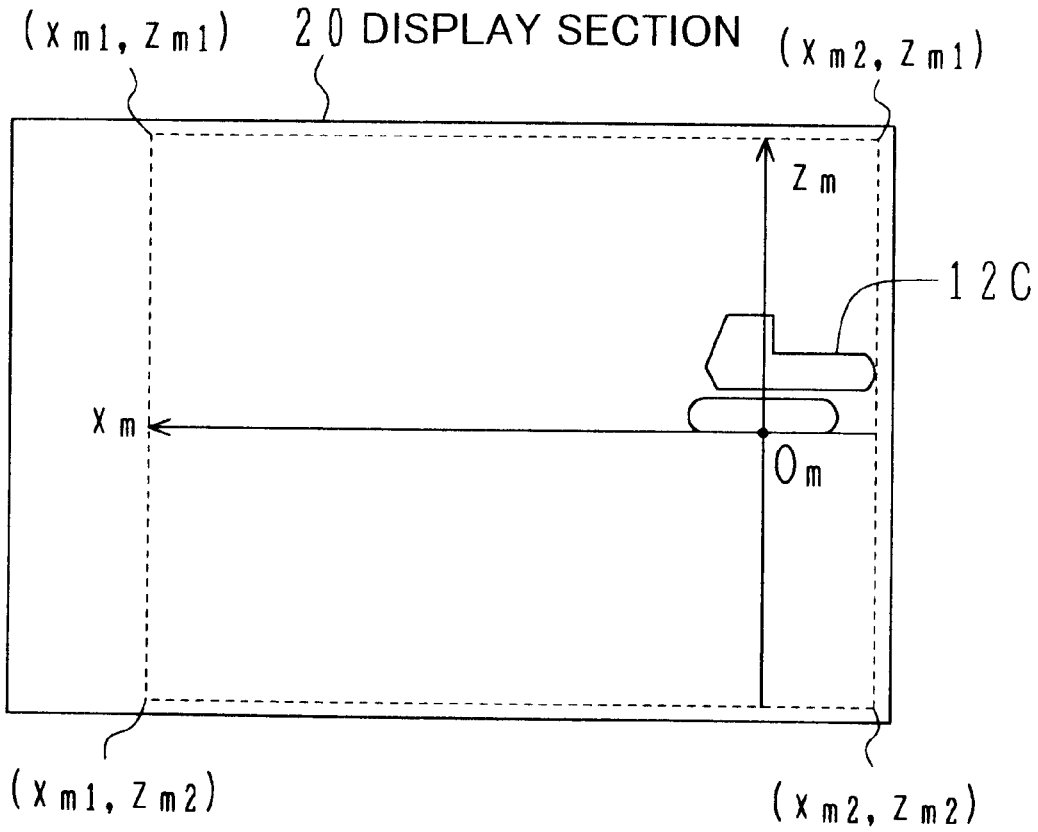
FIG. 8 is an explanatory view of a coordinate system for use in a display device (monitor) according to the first embodiment of the present invention.

The computing section lie for transform of the positional relationship between the body and the laser reference surface into monitor coordinates transforms the linear equation of the laser reference surface R. e.g., z=tan β·x+(PLz−tan β·PLx), into coordinate values on the $x_m$−$z_m$ coordinate system set for a display section 20 of the monitor 12 shown in FIG. 8. In FIG. 8, a coordinate plane of the $x_m$−$z_m$ coordinate system is constituted by a two-dimensional dot matrix, and an area defined by coordinates ($x_{m1}$, $z_{m1}$) and ($x_{m2}$, $z_{m2}$) serves as a display region. Also, an illustration 12*c* of the hydraulic excavator is fixedly displayed on the display section 20, and the origin Om of the $x_m$−$z_m$ coordinate system is set at the center of the bottom surface of the hydraulic excavator represented by the illustration 12*c* in match with the origin O of the x-z coordinate system of the body 1B.

Assuming herein that $x_{m1}$ corresponds to $x_1$ on the x-z coordinate system, a scale K is given by $K=x_{m1}/x_1$. The linear equation z=tan β·x+(PLz−tan β·PLx) of the laser reference surface is therefore expressed by the following formula on the $x_m$−$z_m$ coordinate system:

$$z_m=\tan\beta\cdot x_m+(PLz-\tan\beta PLx)\times K \quad (6)$$

The computing section 11*f* for transform of the positional relationship between the body and the target excavating surface into monitor coordinates transforms, as with the computing section 11*e*, the linear equation of the target excavating surface T, e.g., z=tan β·x+(PLz−tan β·PLx)+Ld expressed by the above formula (4), into coordinate values on the $x_m$−$z_m$ coordinate system of the display section 20 shown in FIG. 8. Assuming a scale $K=x_{m1}/x_1$ also in this case as with the computing section 11*e*, the linear equation of the target excavating surface T is expressed by the following formula on the $x_m$−$z_m$ coordinate system:

$$z_m=\tan\beta\cdot x_m+\{(PLz-\tan\beta\cdot PLx)+Ld\}\times K \quad (7)$$

The computing section 11*g* for producing a picture of the laser reference surface executes processing to produce and output a picture signal for displaying the linear equation of the laser reference surface R obtained by the computing section 11*e* as a straight line on the $x_m$−$z_m$ coordinate system of the display section 20. A straight line representing the laser reference surface R is then displayed on the display section 20 of the monitor 12 as indicated by a broken line 12*a* in FIG. 9.

The computing section 11*h* for producing a picture of the target excavating surface executes processing to produce and output a picture signal for displaying a straight line representing the target excavating surface T obtained by the computing section 11*f* on the $x_m$−$z_m$ coordinate plane of the display section 20. A straight line representing the target excavating surface T is then displayed on the display section 20 of the monitor 12 as indicated by a solid line 12*b* in FIG. 9.

The computing section 11*j* for producing a picture of the hydraulic excavator body executes processing to produce a picture of the body 1B of the hydraulic excavator in the form of an illustration, and processing to produce and output a picture signal for displaying the produced illustration in a fixed position on the $x_m$−$z_m$ coordinate plane of the display section 20 such that the center of the bottom surface of the hydraulic excavator is held in match with the origin Om. The illustration is then displayed on the display section 20 of the monitor 12 as indicated by 12*c* in FIG. 9.

The computing section 11*i* for display of the setting values receives and computes data such as the gradient β of the target excavating surface T, the distance Ld between the laser reference surface R and the target excavating surface T in the depth direction, and the distance LPv from the laser reference surface R to the bucket prong end. Herein, the distance LPv is computed by the following formula (8):

$$LPv=Pvz-\tan\beta Pvx-(PLz-\tan\beta\cdot PLx) \quad (8)$$

Further, the display computing section 11*i* executes processing to produce and output a picture signal for displaying the gradient (setting gradient) β of the target excavating surface T, the distance (setting depth) Ld between the laser reference surface R and the target excavating surface T in the depth direction, and the distance (prong end depth) LPv from the laser reference surface R to the bucket prong end as numerical values on the $x_m$–$z_m$ coordinate plane of the display section 20. Those data are therefore displayed, for example, at the upper left corner in the display section 20 of the monitor 12 as indicated in FIG. 9.

Figure 9:
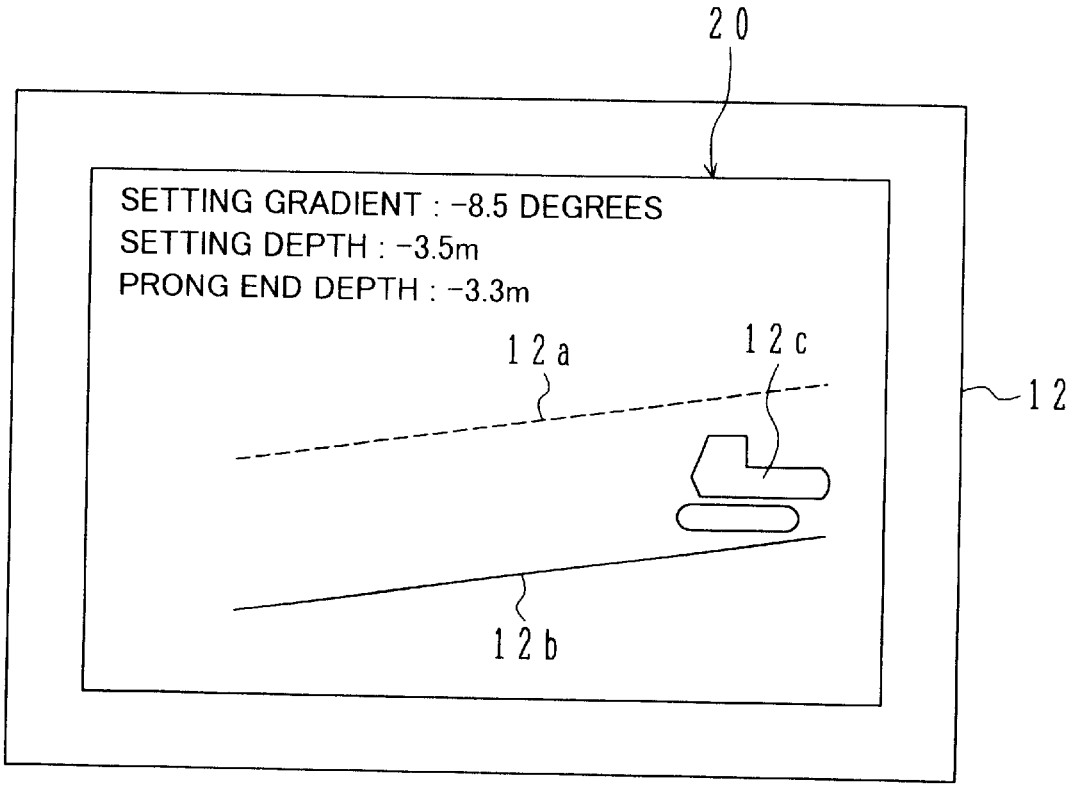
FIG. 9 is an explanatory view of a first display example in the display device of the target excavating-surface setting system of the present invention.

As described above, the positional relationships among the body 1B, the target excavating surface T and the laser reference surface R, and the associated numerical values are displayed on the display section 20 of the monitor 12 as indicated in FIG. 9.

Procedures for setting the target excavating surface based on the method of inputting numerical values according to this embodiment and operating procedures for continuously carrying out excavation along a surface at the predetermined depth and gradient from the laser reference surface (external reference) R in accordance with the set target excavating surface will be described below with reference to FIGS. 6 and 10.

A description is first made of works for setting the target excavating surface at an excavating start position and carrying out excavation.

(Procedure 1)

Figure 10:
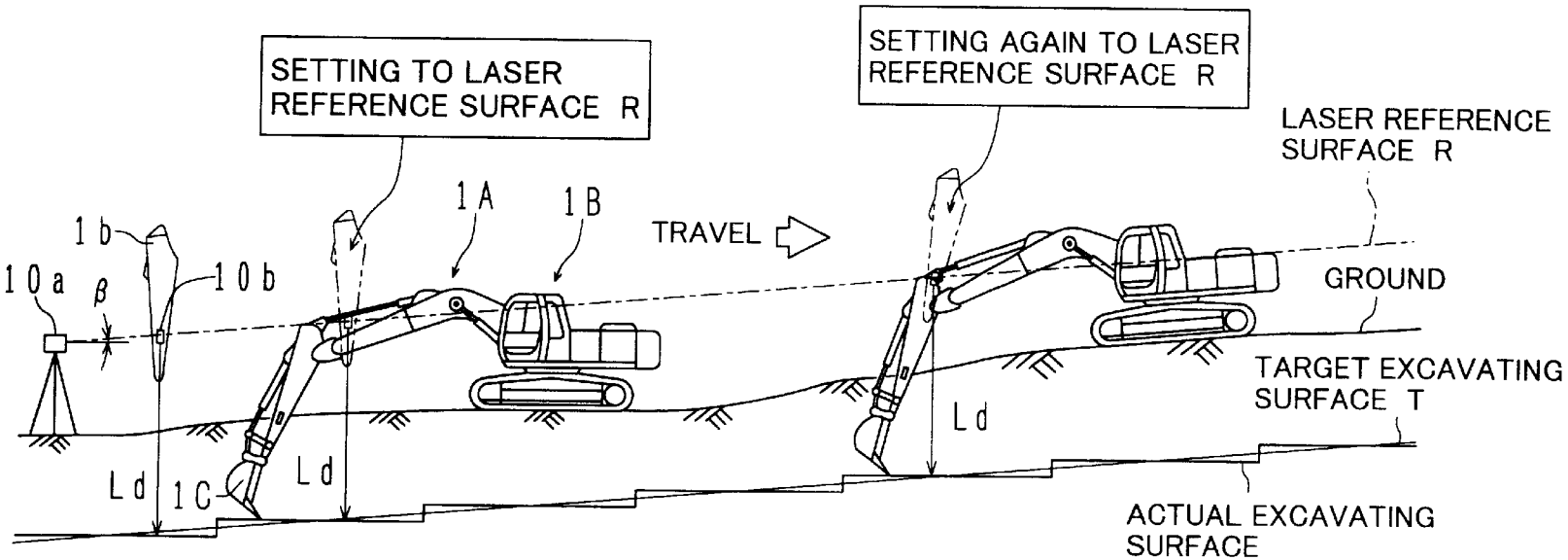
FIG. 10 is an explanatory view showing an excavating manner using the display device and the target excavating-surface setting system of the present invention.

First, as shown in FIG. 10, the operator operates the laser lighthouse 10*a* and sets the laser reference surface R parallel to the target excavating surface that is to be set.

(Procedure 2)

Then, the operator enters and sets the depth (height) Ld from the laser reference surface R to the target excavating surface T by operating the keys 7*a*, 7*b* of the setting device 7 shown in FIG. 5. With this setting operation, the storing section 11*c* stores the depth setting value Ld of the target excavating surface T relative to the laser reference surface R, which is set by the setting device 7. Further, the operator sets the gradient β by employing the keys 7*c*, 7*d* of the setting device 7.

(Procedure 3)

Then, as shown in FIG. 10, the operator moves the front device 1A so that the laser beam receiver 10*b* attached to the arm 1*b* receives the laser beam. With this setting operation, the computing section 11*b* computes, from the formula (3), the linear equation of the laser reference surface R on the x-z coordinate system of the body 1B based on both the coordinate values (PLx, PLz) of the laser beam receiver 10*b* on the x-z coordinate system resulted when the laser beam receiver 10*b* receives the laser beam, and the gradient β set by the setting device 7. Also, the computing and storing section 11*d* computes and stores, from the formula (4), the linear equation of the target excavating surface T on the x-z coordinate system of the body 1B based on both the positional relationship between the body 1B and the laser reference surface R computed by the computing section 11*b* and the depth setting value Ld stored in the storing section 11*c*.

Incidentally, the operation of the procedure 2 and the operation of the procedure 3 until computing the linear equation of the laser reference surface R may be reversed such that the procedure 2 follows the procedure 3.

(Procedure 4)

Based on results of the operation setting in the procedure 2 and the procedure 3, the processing of the computing sections 11*e*–11*j* is further executed. Thereby, as shown in FIG. 9, the body 1B, the laser reference surface R and the target excavating surface T are displayed by the illustration 12*c*, the broken line 12*a* and the solid line 12*b* on the display section 20 of the monitor 12, respectively. At the same time, the gradient β of the target excavating surface T, the setting depth Ld of the target excavating surface T relative to the laser reference surface R, and the distance LPv from the laser reference surface R to the bucket prong end are displayed at the upper left corner of the display section 20.

By looking at the display on the monitor 12, the operator can visually confirm and recognize the positional relationship between the body and the target excavating surface, and the positional relationship between the laser reference surface and the target excavating surface. As a result, the operator can ascertain whether the setting conditions are proper or not.

(Procedure 5)

The operator operates the front device 1A for carrying out automatic excavation along the target excavating surface T stored in the computing and storing section 11*d* under the area limiting excavation control.

(Procedure 6)

After the excavation for the target excavating surface over a predetermined region is completed, the body 1B is traveled as shown in FIG. 10.

A description is next made of works for setting the target excavating surface and carrying out excavation after the travel of the body 1B.

(Procedure 7)

After the travel of the body, as shown in FIG. 10, the operator moves the front device 1A so that the laser beam receiver 10*b* attached to the arm 1*b* receives the laser beam. With this operation, the computing section 11*b* computes the positional relationship between the body 1B and the laser reference surface R, thereby compensating for change of the body position caused upon the travel of the body 1B.

Herein, since the depth setting value Ld relative to the laser reference surface, which has been set by the setting device 7 at the initial setting and stored in the storing section 11*c*, is not changed, the computing and storing section 11*d* computes and stores for update, from the above formula (4), the linear equation of the target excavating surface T on the x-z coordinate system of the body 1B based on both the positional relationship between the body 1B and the laser reference surface R computed by the computing section 11*b* and the depth setting value Ld stored in the storing section 11*c*. With this processing, also after the body 1B has traveled, change in position of the body 1B relative to the laser reference surface R caused upon the travel of the body 1B can be compensated for, and the area limiting excavation control can be continuously performed for the target excavating surface T that is in the predetermined positional relationship relative to the laser reference surface R.

(Procedure 8)

The operator operates the front device 1A for carrying out automatic excavation along the target excavating surface T stored in the computing and storing section 11*d* under the area limiting excavation control.

(Procedure 9)

Subsequently, by repeating the procedures 6 to 8, the automatic excavation is carried out along the surface having the predetermined depth and gradient relative to the laser reference surface R by employing the laser reference surface R as a reference, while the body 1B is traveled successively.

According to this embodiment having the above-described construction, since the lines 12*a*, 12*b* representing the target excavating surface T and the laser reference surface R are displayed on the monitor 12 mounted within the cab in a superimposed relation to the illustration 12*c* of the body 1B. Therefore, the operator can visually recognize not only the positional relationship between the body 1B and the target excavating surface T, but also the positional relationship between the laser reference surface R and the target excavating surface T. Hence, when carrying out excavation continuously over a long distance until and along a surface at a predetermined depth, the target excavating surface T can be easily set without causing a setting error of the target excavating surface T.

Furthermore, since data of the distance between the external reference surface R and the target excavating surface T and the gradient thereof, the distance between the work implement and the laser reference surface R, etc. are displayed in the form of numerical values, the positional relationships among the body 1B, the target excavating surface T and the laser reference surface R can be displayed to the operator in an easily recognizable manner, and a setting error of the target excavating surface T can be avoided with higher certainty.

The processing functions of a setting/display processing section 11A according to a second embodiment of the present invention will be described below with reference to FIGS. 11 and 12. These processing functions correspond to the method of inputting numerical values and to the case where transform into monitor coordinates is carried out on the basis of the target excavating surface. Note that, in FIG. 11, the same symbols as those in FIG. 6 denote the same components.

The construction of a hydraulic excavator according to this embodiment is the same as that shown in FIGS. 1 and 2, and the hardware configuration of a control unit according to this embodiment is the same as that shown in FIG. 3.

Figure 11:
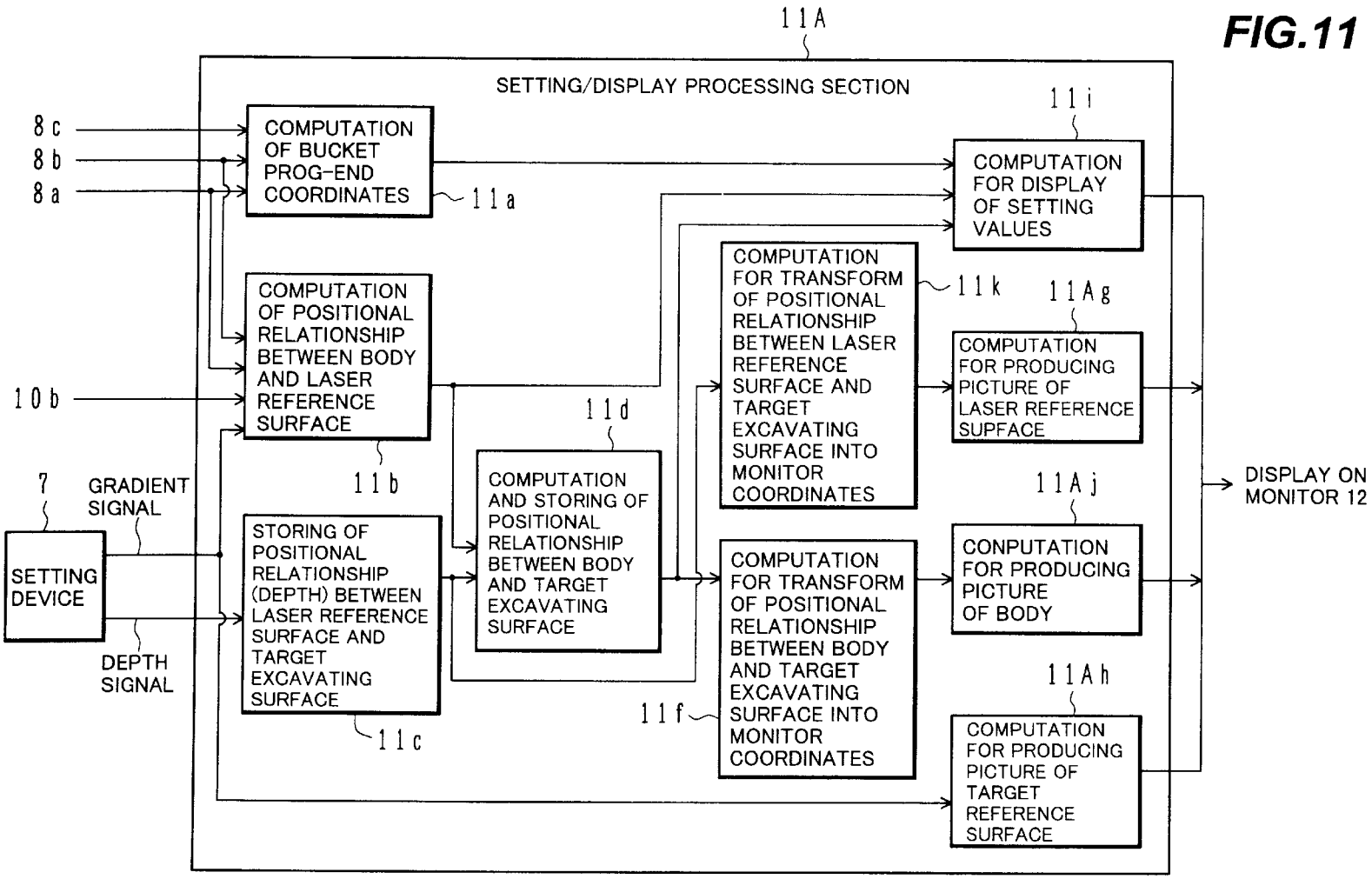
FIG. 11 is a block diagram showing processing functions of a setting/display processing section based on the method of inputting numerical values, which are used in a target excavating-surface setting system for an excavating machine according to a second embodiment of the present invention.

In FIG. 11, the setting/display processing section 11A differs from the setting/display processing section 11 shown in FIG. 6 in that a computing section ilk for transform of the positional relationship between the laser reference surface and the target excavating surface into monitor coordinates; a computing section 11Af for transform of the positional relationship between the body and the target excavating surface into monitor coordinates; a computing section 11Ag for producing a picture of the laser reference surface; a computing section 11Ah for producing a picture of the target excavating surface; and a computing section 11Aj for producing a picture of the body are provided instead of the computing sections 11*e*–11*h* and 11*j* in FIG. 6.

The computing section 11*k* for transform of the positional relationship between the laser reference surface and the target excavating surface into monitor coordinates computes a linear equation of the laser reference surface R on an intermediate orthogonal coordinate system, in which the origin is set at a predetermined position (e.g., a cross point between an x-axis of the x-z coordinate system and the target excavating surface T) on the target excavating surface T, by using the depth setting value Ld of the target excavating surface T relative to the laser reference surface R, which has been stored in the storing section 11*c*. Then, the computing section 11*k* transforms the computed linear equation into coordinate values on the $x_m$–$z_m$ coordinate system of the display section 20 of the monitor 12 shown in FIG. 12. In FIG. 12, a line 12*b* representing the target excavating surface T is displayed on the display section 20, and the origin Om of the $x_m$–$z_m$ coordinate system is fixedly set at a position on the line 12*b* corresponding to the above-mentioned predetermined position on the target excavating surface T. A manner of coordinate transform into the $x_m$–$z_m$ coordinate system is similar to that described above in connection with the computing section 11*e* in the first embodiment.

Figure 12:
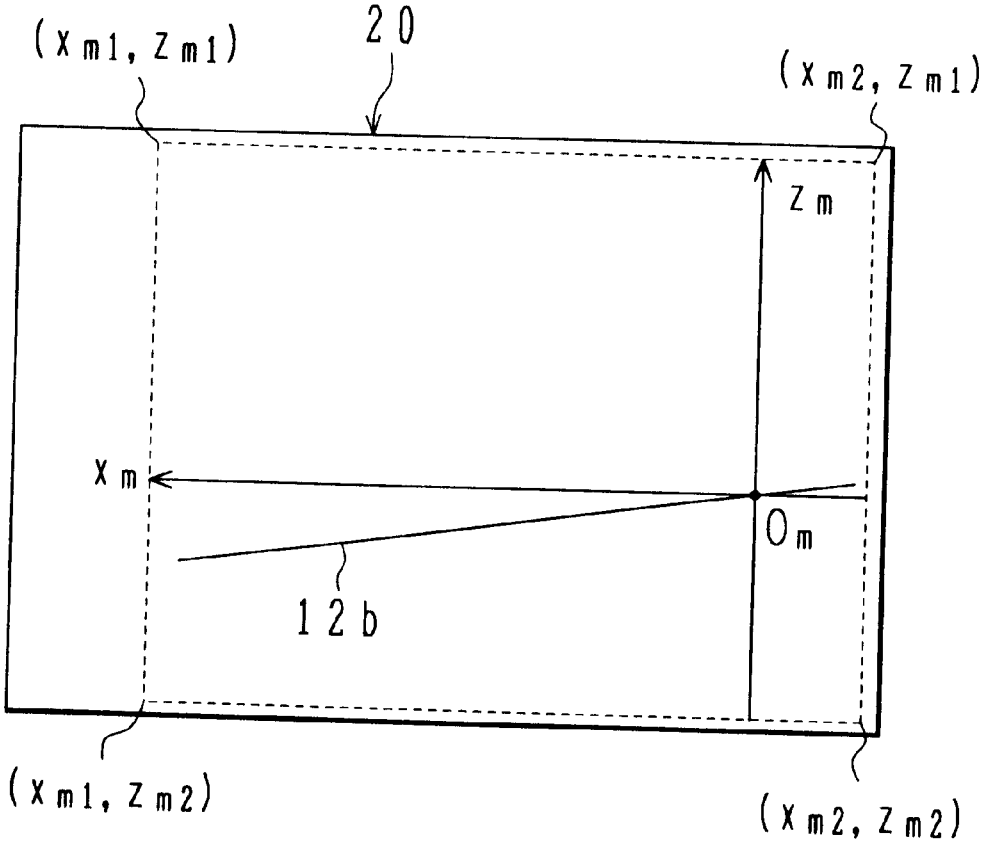
FIG. 12 is an explanatory view of a coordinate system for use in a display device (monitor) according to the second embodiment of the present invention.

The computing section 11Af for transform of the positional relationship between the body and the target excavating surface into monitor coordinates computes a position of the body 1B on the intermediate coordinate system by using the linear equation of the target excavating surface T on the x-z coordinate system of the body 1B computed by the computing section 11*d*, and then transforms the computed values into coordinate values on the $x_m$–$z_m$ coordinate system of the display section 20 shown in FIG. 12. The position of the body 1B is given by the position of the origin O of the x-z coordinate system.

The computing section 11Ag for producing a picture of the laser reference surface executes processing to produce and output a picture signal for displaying the linear equation of the laser reference surface R obtained by the computing section 11*k* as a straight line on the $x_m$–$z_m$ coordinate plane of the display section 20. The straight line representing the laser reference surface R is then displayed on the display section 20 of the monitor 12.

The computing section 11Aj for producing a picture of the body executes processing to produce a picture of the body 1B of the hydraulic excavator in the form of an illustration, and processing to produce and output a picture signal for displaying the produced illustration in a coordinate position, which has been computed by the computing section 11Af, on the $x_m$–$z_m$ coordinate plane of the display section 20. The illustration is then displayed on the display section 20 of the monitor 12

The computing section 11Ah for producing a picture of the target excavating surface executes processing to produce and output, using the gradient β set by the setting device 7, a picture signal for a straight line having the gradient β and passing the origin Om of the $x_m$–$z_m$ coordinate plane of the display section 20. The straight line representing the target excavating surface T is then displayed on the display section 20 of the monitor 12.

As a result of the processing described above, the positional relationships among the body 1B, the target excavating surface T and the laser reference surface R are displayed on the display section 20 of the monitor 12 as shown in FIG. 9.

This embodiment can also provide similar advantages as those in the first embodiment.

The processing functions of a setting/display processing section 11B according to a third embodiment of the present invention will be described below with reference to FIGS. 13 and 14. These processing functions correspond to the method of inputting numerical values and to the case where transform into monitor coordinates is carried out on the basis of the laser reference surface. Note that, in FIG. 13, the same symbols as those in FIG. 6 denote the same components.

The construction of a hydraulic excavator according to this embodiment is the same as that shown in FIGS. 1 and 2, and the hardware configuration of a control unit according to this embodiment is the same as that shown in FIG. 3.

Figure 13:
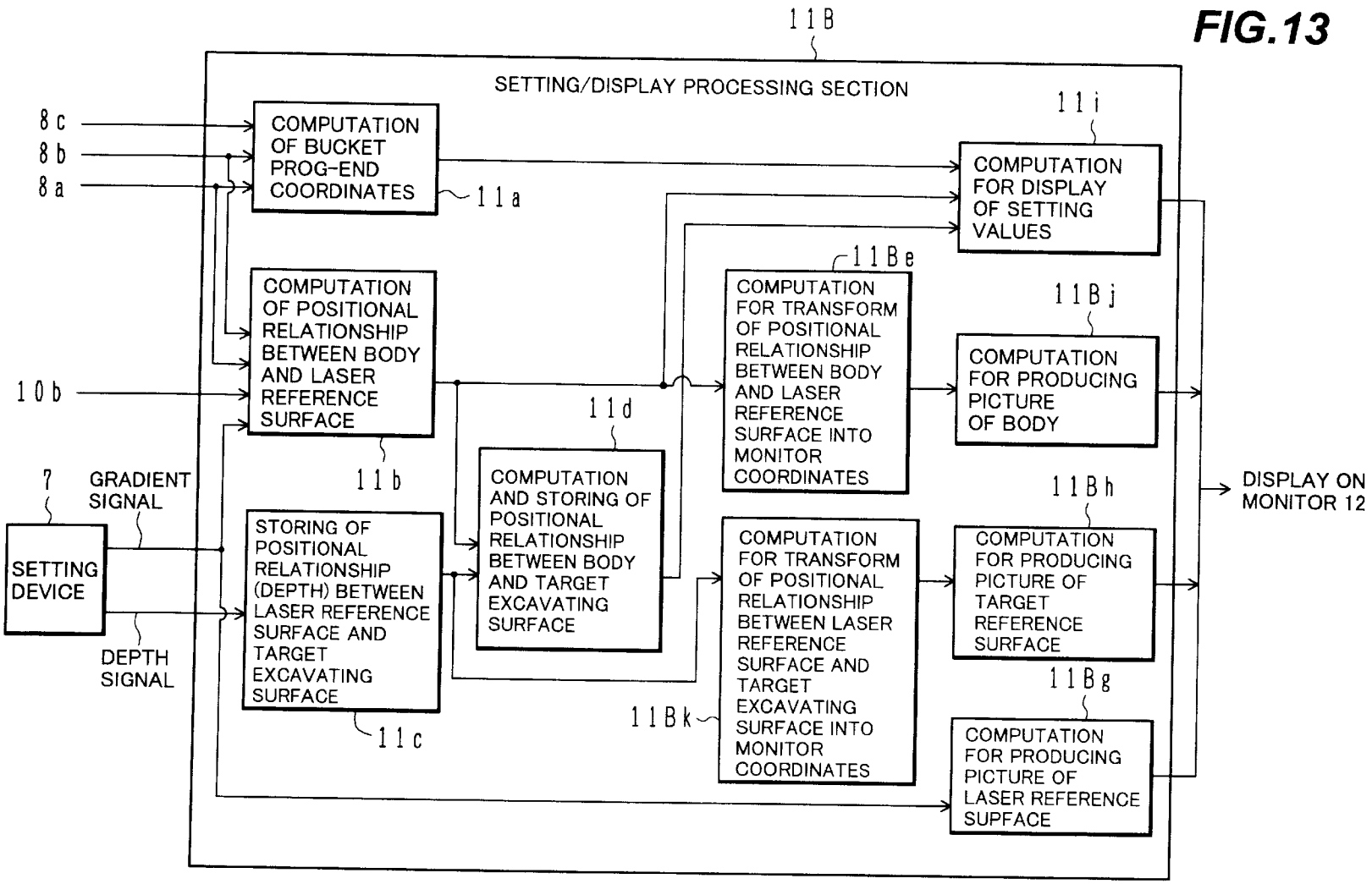
FIG. 13 is a block diagram showing processing functions of a setting/display processing section based on the method of inputting numerical values, which are used in a target excavating-surface setting system for an excavating machine according to a third embodiment of the present invention.

In FIG. 13, the setting/display processing section 11B differs from the setting/display processing section 11 shown in FIG. 6 in that a computing section 11Be for transform of the positional relationship between the body and the laser reference surface into monitor coordinates; a computing section 11Bk for transform of the positional relationship between the laser reference surface and the target excavating surface into monitor coordinates; a computing section 11Bj for producing a picture of the body; a computing section 11Bh for producing a picture of the target excavating surface; and a computing section 11Bg for producing a picture of the laser reference surface are provided instead of the computing sections 11*e*–11*h* and 11*j* in FIG. 6.

Figure 14:
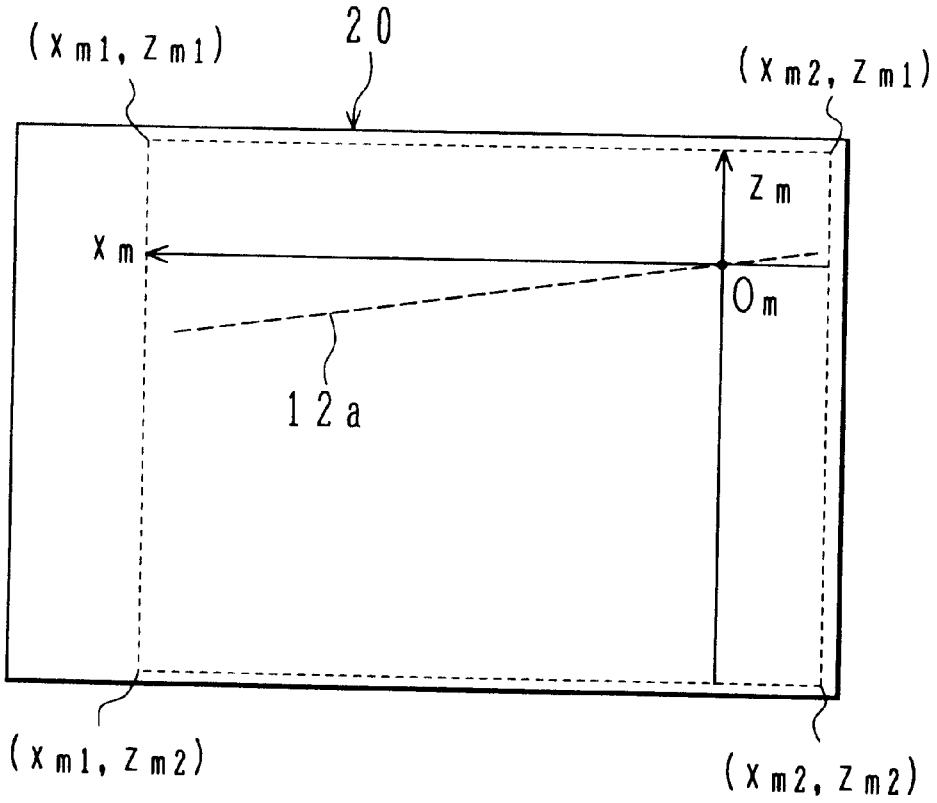
FIG. 14 is an explanatory view of a coordinate system for use in a display device (monitor) according to the third embodiment of the present invention.

The computing section 11Be for transform of the positional relationship between the body and the laser reference surface into monitor coordinates computes a position of the body 1B on an intermediate orthogonal coordinate system, in which the origin is set at a predetermined position (e.g., a cross point between an x-axis of the x-z coordinate system and the laser reference surface R) on the laser reference surface R, by using the linear equation of the laser reference surface R on the x-z coordinate system of the body 1B computed by the computing section lib, and then transforms the computed values into coordinate values on the $x_m$–$z_m$ coordinate system of the display section 20 shown in FIG. 14. The position of the body 1B is given by the position of the origin O of the x-z coordinate system. Further, in FIG. 14, a line 12*a* representing the laser reference surface R is displayed on the display section 20, and the origin Om of the $x_m$–$z_m$ coordinate system is fixedly set at a position on the line 12*a* corresponding to the above-mentioned predetermined position on the laser reference surface R. A manner of coordinate transform into the $x_m$–$z_m$ coordinate system is similar to that described above in connection with the computing section 11*e* in the first embodiment.

The computing section 11Bk for transform of the positional relationship between the laser reference surface and the target excavating surface into monitor coordinates computes a linear equation of the target excavating surface T on the intermediate orthogonal coordinate system by using the depth setting value Ld of the target excavating surface T relative to the laser reference surface R, which has been stored in the storing section 11*c*. Then, the computing section 11Bk transforms the computed linear equation into coordinate values on the $x_m$–$z_m$ coordinate system of the display section 20 of the monitor 12 shown in FIG. 14.

The computing section 11Bj for producing a picture of the body executes processing to produce a picture of the body 1B of the hydraulic excavator in the form of an illustration, and processing to produce and output a picture signal for displaying the produced illustration in a coordinate position, which has been computed by the computing section 11Be, on the $x_m$–$z_m$ coordinate plane of the display section 20. The illustration is then displayed on the display section 20 of the monitor 12.

The computing section 11Bh for producing a picture of the target excavating surface executes processing to produce and output a picture signal for displaying the linear equation of the target excavating surface T obtained by the computing section 11Bk as a straight line on the $x_m$–$z_m$ coordinate plane of the display section 20. The straight line representing the target excavating surface T is then displayed on the display section 20 of the monitor 12.

The computing section 11Bg for producing a picture of the laser reference surface executes processing to produce and output, using the gradient β set by the setting device 7, a picture signal for a straight line having the gradient β and passing the origin Om of the $x_m$–$z_m$ coordinate plane of the display section 20. The straight line representing the laser reference surface R is then displayed in the display section 20 of the monitor 12.

As a result of the processing described above, the positional relationships among the body 1B, the target excavating surface T and the laser reference surface R are displayed on the display section 20 of the monitor 12 as shown in FIG. 9.

This embodiment can also provide similar advantages as those in the first embodiment.

The processing functions of a setting/display processing section 11C according to a fourth embodiment of the present invention will be described below with reference to FIGS. 7 and 15. These processing functions correspond to the direct teaching method. Note that, in FIG. 15, the same symbols as those in FIG. 6 denote the same components.

The construction of a hydraulic excavator according to this embodiment is the same as that shown in FIGS. 1 and 2, and the hardware configuration of a control unit according to this embodiment is the same as that shown in FIG. 3.

In FIG. 15, the setting/display processing section 11C differs from the setting/display processing section 11 shown in FIG. 6 in that a section 11*s* for computing and storing the positional relationship between the body and the target excavating surface and a section 11*t* for computing and storing the positional relationship (depth) between the laser reference surface and the target excavating surface are provided instead of the section 11*c* for storing the positional relationship (depth) between the laser reference surface and the target excavating surface and the section 11*d* for computing and storing the positional relationship between the body and the target excavating surface.

The section 11*s* for computing and storing the positional relationship between and the target excavating surface computes and stores a linear equation of the target excavating surface T on the x-z coordinate system of the body 1B from the following formula (9) based on both coordinate values (Pcx, Pcz) of the bucket prong end on the x-z coordinate system, which has been computed by the section 11*a* for computing bucket prong-end coordinates upon inputting of the direct teaching signal from the setting device 7, and the gradient f set by the setting device 7:

$$z=\tan\beta\cdot x+(Pcz-\tan\beta\cdot Pcx) \quad (9)$$

The section lit for computing and storing the positional relationship (depth) between the laser reference surface and the target excavating surface computes and stores the distance Ld between the laser reference surface R and the target excavating surface T in the depth direction based on both the positional relationship between the body 1B and the laser reference surface R computed by the computing section 11*b* (i.e., the linear equation of the laser reference surface R on the x-z coordinate system, which is expressed by the above-mentioned formula (3) and has been computed from both the coordinate values (PLx, PLz) of the laser beam receiver 10*b* on the x-z coordinate system resulted when the laser beam receiver 10*b* receives the laser beam, and the gradient β set by the setting device 7), and the linear equation of the target excavating surface T, expressed by the above formula (9), on the x-z coordinate system of the body 1B, which has been stored in the computing and storing section 11*s*. Herein, a formula for computing the distance Ld in the depth direction is expressed by the following one (10):

$$Ld=(\text{segment of linear equation of target excavating surface})-(\text{segment of linear equation of laser reference surface}) \quad (10)$$

Further, broken lines in FIG. 15 represent a flow of the processing after travel of the body. Specifically, after the travel of the body, based on both the linear equation (above-mentioned formula (3)) of the laser reference surface R on the x-z coordinate system of the body 1B, which has been computed by the computing section 11*b*, and the distance Ld between the laser reference surface R and the target excavating surface T in the depth direction, which has been stored in the computing and storing section 11*t*, the linear equation of the target excavating surface T on the x-z coordinate system of the body 1B is computed from the above-mentioned formula (4):

$$z=\tan\beta\cdot x+(PLz-\tan\beta\cdot PLx)+Ld \quad (4)$$

The processing functions of the computing sections 11*e*–11*i* are the same as those in the first embodiment shown in FIG. 6. In the computing section 11*f*, however, the linear equation of the target excavating surface T is transformed into coordinate values on the $x_m$–$z_m$ coordinate system of the monitor 12 by employing, as the linear equation of the target excavating surface T on the x-z coordinate system of the body 1B, the above-mentioned formula (9) at the initial excavating position before the travel of the body and the above-mentioned formula (4) after the travel of the body.

As a result of the processing described above, the positional relationships among the body, and the target excavating surface and the laser reference surface, and the associated numerical values are displayed on the monitor 12 as shown in FIG. 9.

Procedures for setting the target excavating surface based on the direct teaching method according to this embodiment and processing procedures for continuously carrying out excavation along a surface at the predetermined depth and gradient from the laser reference surface (external reference) R in accordance with the set target excavating surface will be described below with reference to FIGS. 15 and 10.

A description is first made of works for setting the target excavating surface at an excavating start position and carrying out excavation.

(Procedure 1)

First, as shown in FIG. 10, the operator operates the laser lighthouse 10*a* and sets the laser reference surface R parallel to the target excavating surface that is to be set.

(Procedure 2)

Then, the operator moves the front device 1A so that the prong end of the bucket 1*c* moves to a target point of the excavation, as indicated by two-dot-chain lines in FIG. 7, and then depresses the direct teaching key 7*e* shown in FIG. 5. Also, before or after this operation, the operator sets the gradient β by employing the keys 7*c*, 7*d* of the setting device 7.

With the above setting operation, the computing section 11*a* computes, on the basis of the x-z coordinate system set for the body 1B and the dimensions of the respective components shown in FIG. 7, coordinate values (Pcx, Pcz) of the bucket prong end on the x-z coordinate system from the formulae (1) and (2). Further, the computing and storing section 11*s* computes and stores a linear equation of the target excavating surface T on the x-z coordinate system of the body 1B from the equation (9) based on both the computed coordinate values (Pcx, Pcz) of the bucket prong end on the x-z coordinate system and the gradient β of the laser reference surface.

(Procedure 3)

Then, as shown in FIG. 10, the operator moves the front device 1A so that the laser beam receiver 10*b* attached to the arm 1*b* receives the laser beam. With this setting operation, the computing section 11*b* computes, from the formula (3), a linear equation of the laser reference surface R on the x-z coordinate system of the body 1B based on both the coordinate values (PLx, PLz) of the laser beam receiver 10*b* on the x-z coordinate system resulted when the laser beam receiver 10*b* receives the laser beam, and the gradient β set by the setting device 7. Also, the computing and storing section 11*t* computes and stores, from the formula (10), the depth setting value Ld based on both the positional relationship between the body 1B and the laser reference surface R, which has been computed by the computing section 11*b*, and the linear equation of the target excavating surface T on the x-z coordinate system of the body 1B, which has been stored in the computing and storing section 11*s*.

Incidentally, the operation of the procedure 2 and the operation of the procedure 3 until computing the linear equation of the laser reference surface R may be reversed such that the procedure 2 follows the procedure 3.

(Procedure 4)

Based on results of the operation setting in the procedure 2 and the procedure 3, the processing of the computing sections 11*e*–11*j* is further executed. Thereby, as shown in FIG. 9, the body 1B, the laser reference surface R and the target excavating surface T are displayed by an illustration 12*c*, a broken line 12*a* and a solid line 12*b* on the display section 20 of the monitor 12, respectively. At the same time, the gradient β of the target excavating surface T, the setting depth Ld of the target excavating surface T relative to the laser reference surface R, and the distance LPv from the laser reference surface R to the bucket prong end are displayed at the upper left corner of the display section 20.

By looking at the display on the monitor 12, the in operator can visually confirm and recognize the positional relationship between the body and the target excavating surface, and the positional relationship between the laser reference surface and the target excavating surface. As a result, the operator can ascertain whether the setting conditions are proper or not.

(Procedure 5)

The operator operates the front device 1A for carrying out automatic excavation along the target excavating surface stored in the computing and storing section 11*s* under the area limiting excavation control.

(Procedure 6)

After the excavation for the target excavating surface over a predetermined region is completed, the body 1B is traveled as shown in FIG. 10.

A description is next made of works for setting the target excavating surface and carrying out excavation after the travel of the body 1B.

(Procedure 7)

After the travel of the body, as shown in FIG. 10, the operator moves the front device 1A so that the laser beam receiver 10*b* attached to the arm 1*b* receives the laser beam. With this operation, the computing section 11*b* computes the positional relationship between the body 1B and the laser reference surface R, thereby compensating for change of the body position caused upon the travel of the body 1B.

Herein, since the depth setting value Ld relative to the laser reference surface R, which is stored in the computing and storing section 11*t*, is not changed, the computing and storing section 11*s* computes and stores for update, from the above formula (4), the linear equation of the target excavating surface T on the x-z coordinate system of the body 1B based on both the positional relationship between the body 1B and the laser reference surface R computed by the computing section 11*b* and the depth setting value Ld stored in the computing and storing section 11*t*. With this processing, also after the body 1B has traveled, change in position of the body 1B relative to the laser reference surface R caused upon the travel of the body 1B can be compensated for, and the area limiting excavation control can be continuously performed for the target excavating surface T that is in the predetermined positional relationship relative to the laser reference surface R.

(Procedure 8)

The operator operates the front device 1A for carrying out automatic excavation along the target excavating surface T stored in the computing and storing section 11*s* under the area limiting excavation control.

(Procedure 9)

Subsequently, by repeating the procedures 6 to 8, the automatic excavation is carried out along the surface having the predetermined depth and gradient relative to the laser reference surface R by employing the laser reference surface R as a reference, while the body 1B is traveled successively.

According to this embodiment having the above-described construction, similar advantages as those in the first embodiment can also be obtained in the case of employing the direct teaching method.

In the embodiment shown in FIG. 15, the processing to execute transform into monitor coordinates and then to produce and output picture signals after computing the positional relationships among the body 1B, the laser reference surface R and the target excavating surface T by the computing section 11*b* and the computing and storing sections 11*s*, 11*t* is assumed to be the same as the processing executed by the computing sections 11*e*–11*h* and 11*j* in the first embodiment shown in FIG. 6. The computing sections 11*e*–11*h* and 11*j* are employed in the case of transform into monitor coordinates on the basis of the body. However, transform into monitor coordinates may be executed on the basis of the target excavating surface or the laser reference surface as with the second and third embodiments.

FIGS. 16 and 17 are block diagrams showing the processing functions executed by setting/display processing sections in such cases. More specifically, FIG. 16 shows, as a fifth embodiment of the present invention, the processing functions of a setting/display processing section 11D adapted for the case where transform into monitor coordinates is executed on the basis of the target excavating surface, and FIG. 17 shows, as a sixth embodiment of the present invention, the processing functions of a setting/display processing section 11E adapted for the case where transform into monitor coordinates is executed on the basis of the laser reference surface. In FIG. 16, the same symbols as those in FIGS. 11 and 15 denote the same components. In FIG. 17, the same symbols as those in FIGS. 13 and 15 denote the same components.

These embodiments can also provide similar advantages as those in the first embodiment in the case of employing the direct teaching method.

A second display example in the display device for the target excavating-surface setting system of the present invention will be described below with reference to FIG. 18.

As described above in connection with FIG. 9, the straight line 12*a* representing the laser reference surface R, the straight line 12*b* representing the target excavating surface T, and the illustration 12*c* of the body 1B of the hydraulic excavator are displayed on the display section 20 of the monitor 12. In addition, in this display example, a current bucket end position 12*d* is displayed on a screen of the display section 20 in a superimposed manner for clearly indicating the positional relationship between the target excavating surface and the bucket end, and a line 12*e* extended along the lower travel structure of the body 1B and representing the ground is displayed as an auxiliary line on the screen of the display section 20. This second display example enables the operator to more precisely confirm current situations including a current position of the work implement and a relation relative to the ground.

Figure 19:
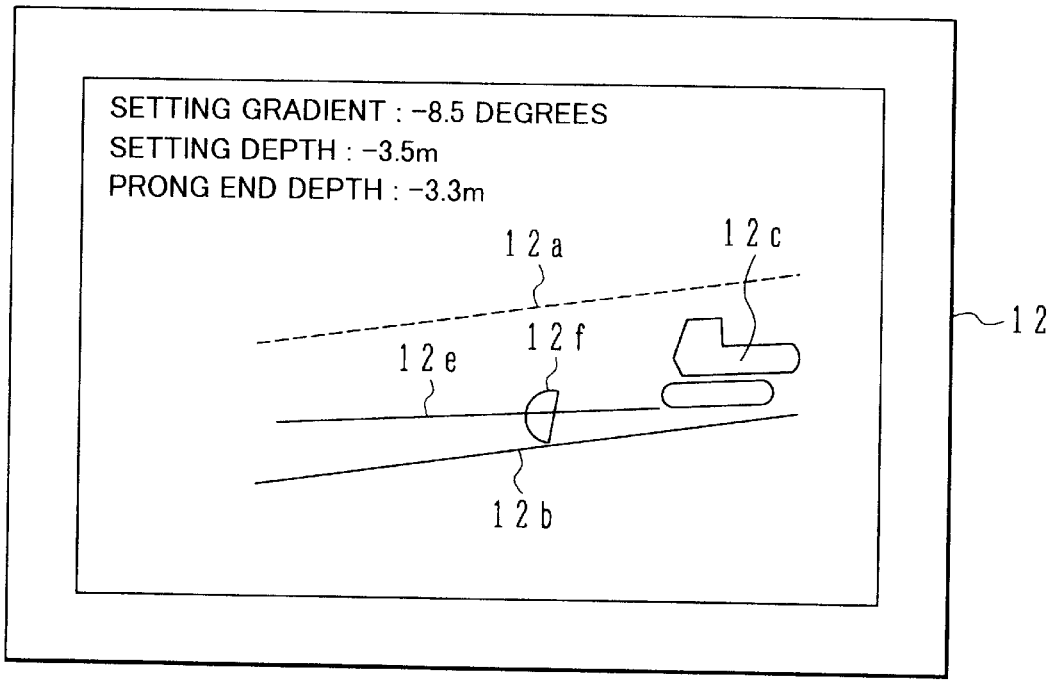
FIG. 19 is an explanatory view of a third display example in the display device of the target excavating-surface setting system of the present invention.

A third display example in the display device for the target excavating-surface setting system of the present invention will be described below with reference to FIG. 19.

Figure 18:
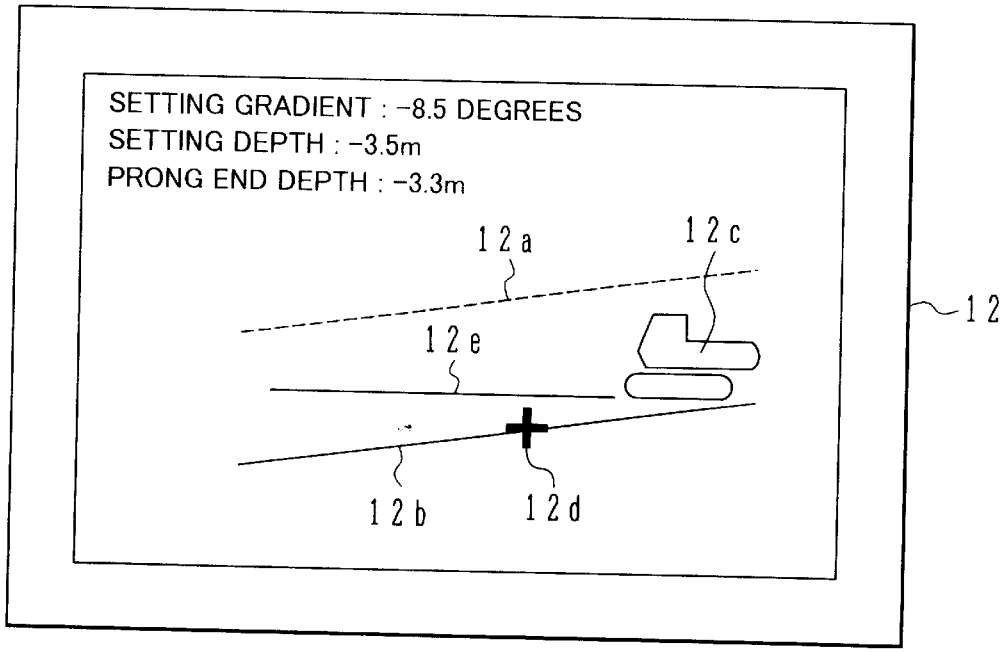
FIG. 18 is an explanatory view of a second display example in the display device of the target excavating-surface setting system of the present invention.

This third display example differs from the second display example of FIG. 18 in that a current position of the work implement, e.g., the bucket, is displayed in the form of an illustration 12*f* of the bucket. Also, by providing an inclinometer to detect a gradient of the body in the back-and-forth direction, a line 12*e* extended along the lower travel structure of the body 1B and representing the ground and the illustration 12*c* of the body 1B are displayed at an inclination depending on the detected gradient. Accordingly, this third display example enables the operator to more precisely confirm current situations including a current position of the work implement, an inclination of the body, and a ground condition.

Figure 20:
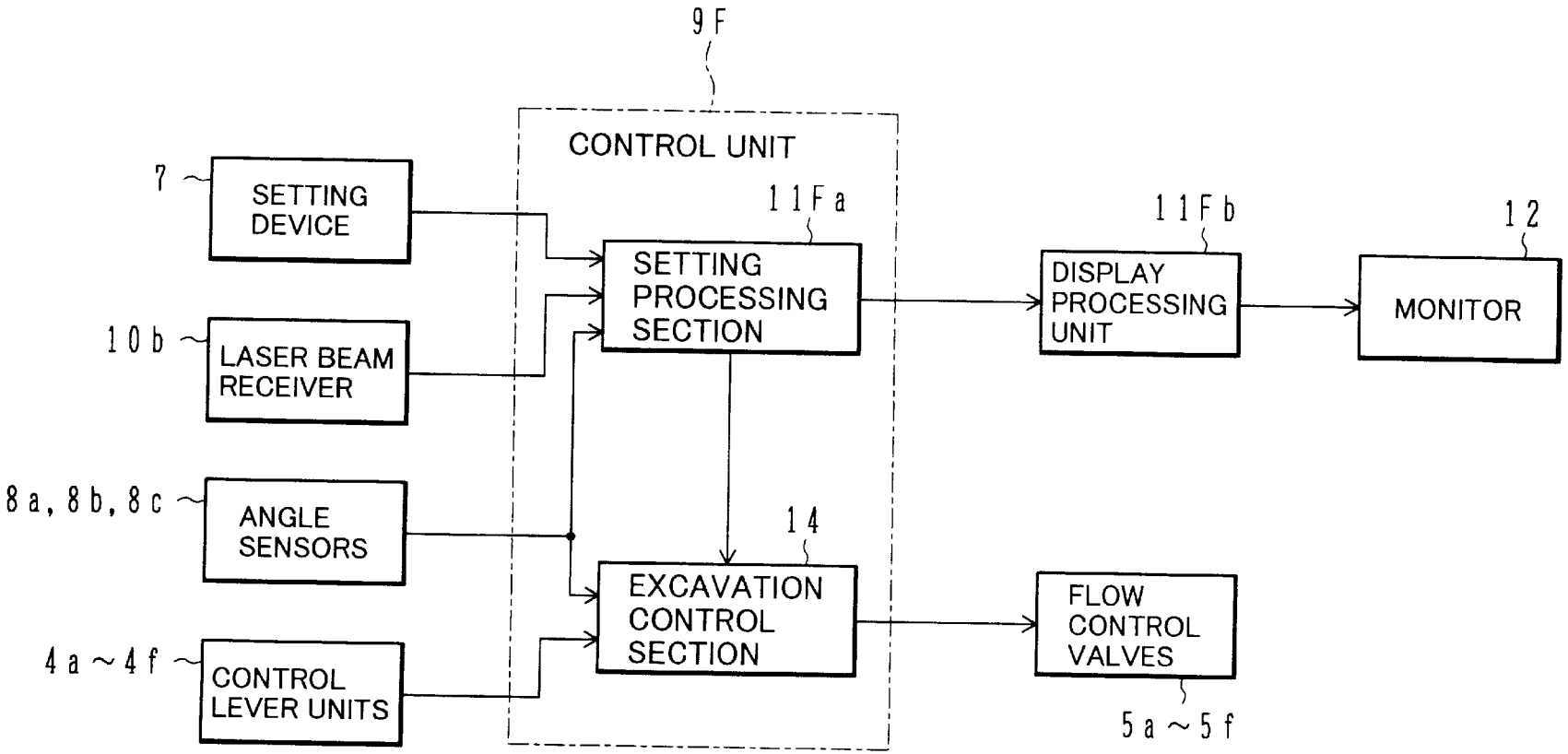
FIG. 20 is a diagram showing a target excavating-surface setting system for an excavating machine according to still another embodiment of the present invention, along with processing functions of a control unit.
Figure 21:
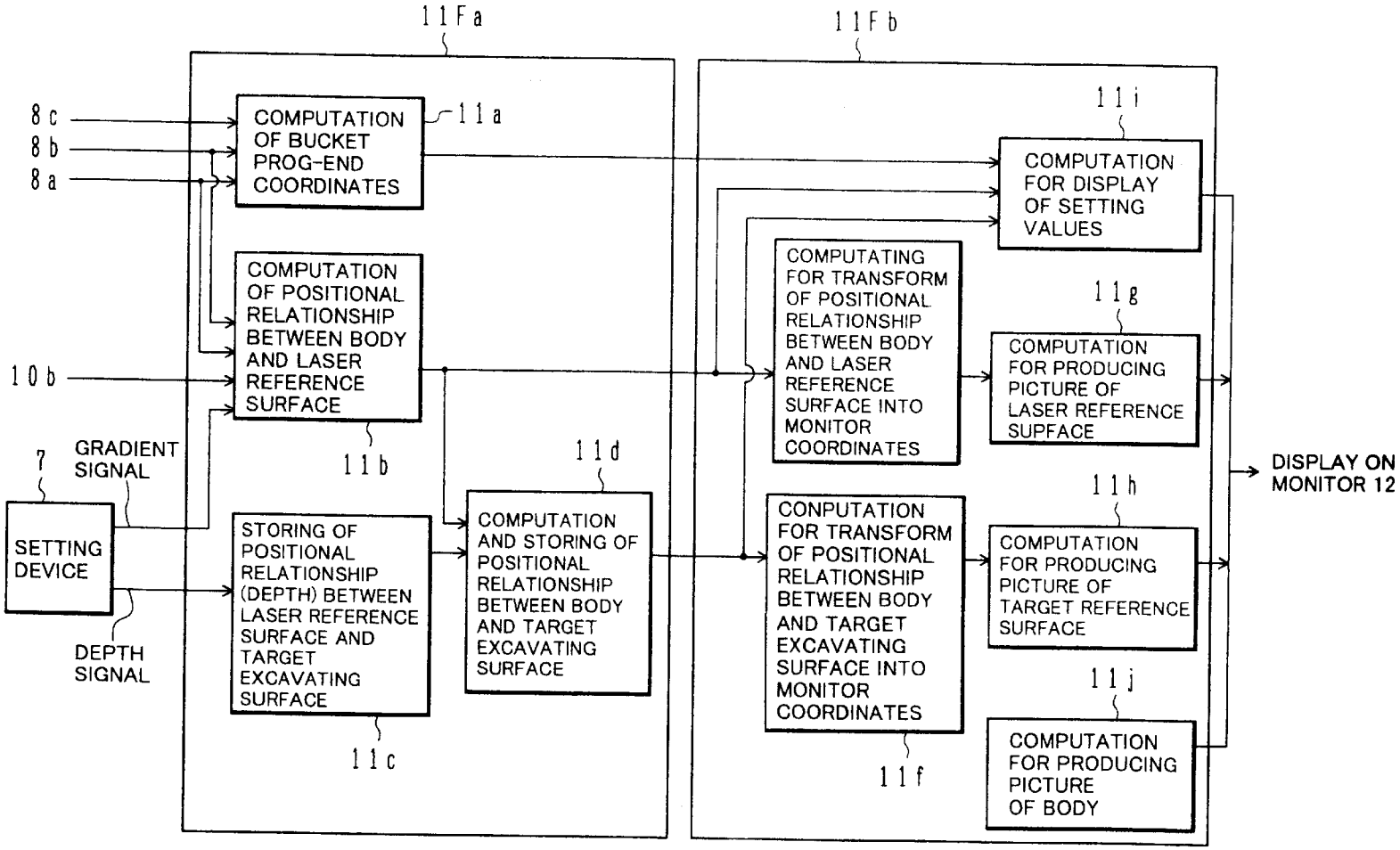
FIG. 21 is a block diagram showing processing functions of a setting processing section in the control unit and a display processing unit in FIG. 20.

Still another embodiment of the present invention will be described with reference to FIGS. 20 and 21. In this embodiment, a display processing section is separated from the setting/display processing section disposed in the control unit, and is provided as a display processing unit separate from the control unit. In FIGS. 20 and 21, members identical to those in FIGS. 4 and 6 are denoted by the same symbols.

In FIG. 20, a control unit 9F comprises a setting processing section 11Fa for setting the target excavating surface T and computing the positional relationships among the body 1B, the laser reference surface R and the target excavating surface T, and an excavation control section 14 for carrying out area limiting excavation control. Also, a display processing unit 11Fb is provided separately from the control unit 9F.

In FIG. 21, the setting processing section 11Fa includes respective functions executed by a section 11*a* for computing bucket prong-end coordinates; a section 11*b* for computing the positional relationship between the body and the laser reference surface; a section 11*c* for storing the positional relationship (depth) between the laser reference surface and the target excavating surface; and a section 11*d* for computing and storing the positional relationship between the body and the target excavating surface. The display processing unit 11Fb comprises a computing section 11*e* for transform of the positional relationship between the body and the laser reference surface into monitor coordinates; a computing section 11*f* for transform of the positional relationship between the body and the target excavating surface into monitor coordinates; a computing section 11*g* for producing a picture of the laser reference surface; a computing section 11*h* for producing a picture of the target excavating surface; and a computing section 11*i* for display of the setting values; and a computing section 11*j* for producing a picture of the body.

A monitor 12 is mounted within a cab at a corner obliquely in front of an operator seat. A control unit 9Fa is mounted within the cab at a position, for example, behind and below the operator seat, and the display processing unit 11Fb is mounted, for example, in a console box disposed laterally of the operator seat.

This embodiment can also provide similar advantages as those in the first embodiment.

Further, with this embodiment, since the processing to produce and output a picture signal is executed by the dedicated processing unit 11Fb, it is easily possible for the display processing unit 11Fb to have an additional processing function to produce and output a picture signal for another information, such as information of maintenance and inspection transmitted through a communicating satellite. The display device is therefore adaptable for multiple purposes in use.

The target excavating-surface setting system and the display device of the present invention are not limited in details to the embodiments described above, but may be modified in various ways. For example, while the laser reference surface defined by a laser beam is used as the external reference in the above-described embodiments, any other suitable external reference, e.g., a leveling string, may also be used. In the case of using a leveling string as the external reference, the positional relationship between the body and the laser reference surface may be computed by the computing section 11*b* by moving the front device such that the bucket prong end contacts the leveling string, depressing a trigger switch in that condition, and then employing detection values of the angle sensors 8*a*, 8*b* and 8*c* at that time. Also, while the laser beam receiver 10*b* is attached to the lateral surface of the arm in the case of using the laser reference surface, a front reference may be marked on the lateral surface of the arm by the use of a panel, painting or the like, instead of the laser beam receiver 10*b*. In such a case, the positional relationship between the body and the laser reference surface can also be computed by the computing section 11*b*, as with the case of using a leveling string, by depressing the trigger switch at the time when a laser beam impinges upon the front reference mark.

Further, in the present invention, when carrying out excavation after setting the target excavating surface, the excavation is not limited to be performed under area limiting excavation control, but may be performed under any other suitable excavation control. Moreover, the display example on the display device, shown in FIG. 9, 18 or 19, may be modified such that the target excavating surface and the external reference surface are drawn in different display colors and/or different line types, thus allowing the operator to more easily visually discern those surfaces.

Additionally, while electrical levers are used as the control levers in the above-described embodiments, they may be replaced by hydraulic pilot levers. Also, while angle sensors for detecting rotational angles are employed as means for detecting the status variables relating to the position and the posture of the front device 1A, the stroke of each cylinder may be detected instead.

Industrial Applicability

According to the present invention, a target excavating surface can be easily set using an external reference when excavation is carried out continuously over a long distance until and along a surface at a predetermined depth.

What is claimed is:

1. A target excavating-surface setting system for an excavating machine, in which a target excavating surface (T) is set parallel to an external reference (R) installed outside a machine body (1B) and a front device (1A) is controlled for said target excavating surface, thereby carrying out excavation continuously along said target excavating surface, wherein said system comprises:

input means (7) for setting said target excavating surface (T);

detecting means (8*a*,8*b*) for detecting status variables relating to a position and a posture of said front device (1A);

first computing means (11*b*,11*c*; 11*b*,11*s*,11*t*) for computing positional relationships among said body (1B), said external reference (R) and said target excavating surface (T) by using signals from said input means and said detecting means; and second computing means (11*e*–11*h*,11*j*) for executing picture processing by using the positional relationships computed by said first computing means, and producing and outputting picture signals to display the positional relationships among said body, said external reference and said target excavating surface.

2. A target excavating-surface setting system for an excavating machine according to claim 1, wherein said first computing means comprises:

first means (11*b*) for computing the positional relationship of said body (1B) relative to said external reference (R) by using the signals from said detecting means (8*a*,8*b*); and second means (11*c*; 11*s*,11*t*) for computing the positional relationship between said external reference (R) and said target excavating surface (T) by using at least the signals from said input means (7).

3. A target excavating-surface setting system for an excavating machine according to claim 1, wherein:

said input means (7) includes numerical value input means (7*a*,7*b*) for inputting a depth from said external reference (R) to said target excavating surface (T), and said first computing means comprises:

third computing means (11*b*) for computing the positional relationship between said body (1B) and said external reference (R) by using the signals supplied from said detecting means (8*a*,8*b*) when said front device (1A) is in a predetermined positional relationship relative to said external reference; and first setting means (11*c*) for setting the positional relationship between said external reference and said target excavating surface by using the signals from said numerical value input means (7*a*,7*b*).

4. A target excavating-surface setting system for an excavating machine according to claim 3, wherein:

said first computing means further comprises fourth computing means (11*d*) for computing the positional relationship between said body (1B) and said target excavating surface (T) by using values computed by said third computing means (11*b*) and a value set by said first setting means (11*c*), and said second computing means comprises:

first transforming means (11*e*,11*g*) for executing processing to transform the values computed by said third computing means (11*b*) into values on a monitor coordinate system set for a display section (20) of a display device (12) on the basis of said body (1B), and to display the positional relationship between said body and said external reference (R) on said display section; and second transforming means (11*f*,11*h*) for executing processing to transform values computed by said fourth computing means (11*d*) into values on said monitor coordinate system on the basis of said body (1B), and to display the positional relationship between said body and said target excavating surface on said display section.

5. A target excavating-surface setting system for an excavating machine according to claim 1, wherein:

said input means (7) includes direct-teaching instructing means (7*e*) operated when a work implement (1*c*) provided as said front device (1A) is at a predetermined depth, and said first computing means comprises:

fourth computing means (11*a*,11*s*) for computing the positional relationship between said body (1B) and said target excavating surface (T) by using the signals supplied from said detecting means (8*a*,8*b*,8*c*) when said direct-teaching instructing means (7*e*) is operated;

fifth computing means (11*b*) for computing the positional relationship between said body and said external reference (R) by using the signals supplied from said detecting means (8*a*,8*b*) when said front device is in a predetermined positional relationship relative to said external reference; and sixth computing means (11*t*) for computing the positional relationship between said external reference and said target excavating surface by using values computed by said fourth and fifth computing means.

6. A target excavating-surface setting system for an excavating machine according to claim 5, wherein:

said first computing means further comprises seventh computing means (11*s*) for computing the positional relationship between said body (1B) and said target excavating surface (T) by using values computed by said fifth and sixth computing means (11*b*,11*t*), and said second computing means comprises:

first transforming means (11*e*,11*g*) for executing processing to transform the values computed by said fifth computing means (11*b*) into values on a monitor coordinate system set for a display section (20) of a display device (12) on the basis of said body (1B), and to display the positional relationship between said body and said external reference (R) on said display section; and second transforming means (11*f*,11*h*) for executing processing to transform the values computed by said fourth computing means (11*a*,11*s*) or said seventh computing means (11*s*) into values on said monitor coordinate system on the basis of said body, and to display the positional relationship between said body (1B) and said target excavating surface on said display section.

7. A target excavating-surface setting system for an excavating machine according to claim 1, wherein:

said input means (7) includes means (7*c*,7*d*) for setting a gradient of said external reference (R), said first computing means (11*b*,11*c*; 11*b*,11*s*,11*t*) computes the positional relationships among said body (1B), said external reference (R) and said target excavating surface (T), including a set value of said gradient, and said second computing means (11*e*–11*h*,11*j*) produces the picture signals for displaying said external reference and said target excavating surface depending on said gradient.

8. A target excavating-surface setting system for an excavating machine according to claim 1, further comprising a display device (12,20) for displaying, in accordance with the computed positional relationships, a picture (12*c*) representing said body (1B) and straight lines (12*a*, 12*b*) representing respectively said external reference (R) and said target excavating surface (T) by using the picture signals outputted from said second computing means (11*e*–11*h*,11*j*).

9. A target excavating-surface setting system for an excavating machine according to claim 1, wherein:

said first computing means (11*b*,11*c*; 11Fa) is disposed in a first control unit (9F), and said second computing means (11*e*–11*h*,11*j*) is disposed in a second control unit (11Fb) separate from said first control unit.

10. A storage medium (93) storing a target excavating-surface setting program for an excavating machine, in which a target excavating surface (T) is set parallel to an external reference (R) installed outside a machine body (1B) and a front device (1A) is controlled for said target excavating surface, thereby carrying out excavation continuously along said target excavating surface, wherein said program operates a computer (92) to execute the steps of:

computing positional relationships among said body (1B), said external reference (R) and said target excavating surface (T) by using a signal from input means (7) for setting said target excavating surface (T) and signals from detecting means (8*a*,8*b*) for detecting status variables relating to a position and a posture of said front device (1A); and executing picture processing by using the computed positional relationships for producing and outputting picture signals to display the positional relationships among said body, said external reference and said target excavating surface.

11. A display device (12) for use in a target excavating-surface setting program for an excavating machine, in which a target excavating surface (T) is set parallel to an external reference (R) installed outside a machine body (1B) and a front device (1A) is controlled for said target excavating surface, thereby carrying out excavation continuously along said target excavating surface, wherein:

said-display device comprises a display section (20) for taking in picture signals representing previously computed positional relationships among said body (1B), said external reference (R) and said target excavating surface (T), and displaying a picture (12*c*) representing said body and straight lines (12*a*,12*b*) representing respectively said external reference and said target excavating surface in accordance with the previously computed positional relationships.

* * * * *